US011473787B2

(12) United States Patent
Hu et al.

(10) Patent No.: US 11,473,787 B2
(45) Date of Patent: Oct. 18, 2022

(54) BOILER FOR HEATING AND HOT-WATER CONTROL METHOD THEREFOR

(71) Applicant: KYUNGDONG NAVIEN CO.,LTD., Gyeonggi-do (KR)

(72) Inventors: Chang Heoi Hu, Seoul (KR); Yong Min Song, Seoul (KR); Si Hwan Kim, Seoul (KR)

(73) Assignee: KYUNGDONG NAVIEN CO., LTD, Gyeonggi-Do (KR)

( * ) Notice: Subject to any disclaimer, the term of this patent is extended or adjusted under 35 U.S.C. 154(b) by 0 days.

(21) Appl. No.: 17/054,076

(22) PCT Filed: May 8, 2019

(86) PCT No.: PCT/KR2019/005480
§ 371 (c)(1),
(2) Date: Nov. 9, 2020

(87) PCT Pub. No.: WO2019/216635
PCT Pub. Date: Nov. 14, 2019

(65) Prior Publication Data

US 2021/0239327 A1 Aug. 5, 2021

(30) Foreign Application Priority Data

May 8, 2018 (KR) ..... 10-2018-0052261
May 7, 2019 (KR) ..... 10-2019-0053234

(51) Int. Cl.
*F24D 3/08* (2006.01)
*F24D 19/10* (2006.01)
(Continued)

(52) U.S. Cl.
CPC ..... *F24D 19/1051* (2013.01); *F24H 1/52* (2013.01); *F24H 9/20* (2013.01)

(58) Field of Classification Search
CPC ... F24D 3/02; F24D 3/08; F24D 3/087; F24D 19/1051
See application file for complete search history.

(56) References Cited

U.S. PATENT DOCUMENTS 9,869,490 B2 * 1/2018 Min ..... F24D 19/1066
9,945,566 B2 * 4/2018 Park ..... F24D 17/0031
(Continued)

FOREIGN PATENT DOCUMENTS

CN 101981387 A 2/2011
CN 103453566 A 12/2013
(Continued)

OTHER PUBLICATIONS

Office Action for corresponding Chinese patent application No. 201980031268.2 dated Jul. 26, 2021, 23 pages.
(Continued)

*Primary Examiner* — Gregory A Wilson
(74) *Attorney, Agent, or Firm* — Wegman Hessler

(57) ABSTRACT

The present invention provides a combined heating and hot-water boiler for heating and hot-water. The combined heating and hot-water boiler comprises: a main heat exchanger which heats heating water through heat exchange; a hot-water heat exchanger to which the heating water heated by the main heat exchanger is supplied, and which heats tap water into hot water through heat exchange with the heating water; and a control unit which controls the flow of the heating water having passed through the hot-water heat exchanger to control the formation of at least one of a first flow path for supplying, to an object to be heated, the heating water having passed through the hot-water heat exchanger, and a second flow path for supplying, to the main heat exchanger, the heating water having passed through the hot-water heat exchanger.

22 Claims, 18 Drawing Sheets

(51) Int. Cl.
*F24H 1/52* (2022.01)
*F24H 9/20* (2022.01)

(56) References Cited

U.S. PATENT DOCUMENTS

| | | | | |
|---|---|---|---|---|
| 2011/0017152 | A1 | 1/2011 | Min | |
| 2015/0090199 | A1 | 4/2015 | Min | |
| 2015/0204577 | A1* | 7/2015 | Son | F24H 9/2007 122/14.1 |
| 2015/0300661 | A1 | 10/2015 | Park et al. | |
| 2017/0363301 | A1* | 12/2017 | Son | F24D 19/1051 |
| 2020/0263880 | A1* | 8/2020 | Magnone | F16K 11/0708 |
| 2020/0386418 | A1* | 12/2020 | Choi | F24D 17/001 |

FOREIGN PATENT DOCUMENTS

| | | | | |
|---|---|---|---|---|
| CN | 104781618 | A | 7/2015 | |
| CN | 104838209 | A | 8/2015 | |
| CN | 107110558 | A | 8/2017 | |
| EP | 569713 | * | 11/1993 | |
| KR | 10-1996-0024096 | A | 8/1998 | |
| KR | 10-2010-0036569 | A | 4/2010 | |
| KR | 10-2011-0120619 | A | 11/2011 | |
| KR | 10-1355436 | B1 | 1/2014 | |
| KR | 10-2014-0060773 | A | 5/2014 | |
| KR | 10-1379766 | B | 9/2014 | |
| KR | 10-2017-0075235 | A | 7/2017 | |
| WO | WO-2011149191 | A2 * | 12/2011 | F24D 11/005 |
| WO | 2014092323 | A1 | 6/2014 | |

OTHER PUBLICATIONS

International Search Report and Written Opinion for International Patent Application No. PCT/KR2019/005480 dated Aug. 7, 2019, 11 pages long.

Notice of Allowance for corresponding Korean Patent Application No. 10-2019-0053234 dated Jul. 22, 2022, 2 pages.

* cited by examiner

BOILER FOR HEATING AND HOT-WATER CONTROL METHOD THEREFOR

CROSS-REFERENCE TO RELATED APPLICATIONS

This application is the US national phase entry of International Patent Application No. PCT/KR2019/005480 filed May 8, 2019, which claims priority to Korean Patent Application Nos. 10-2018-0052261, filed on May 8, 2018 and 10-2019-0053234 filed May 7, 2019, all of the above listed applications are herein incorporated by reference.

TECHNICAL FIELD

The present disclosure relates to a boiler for heating and hot-water and a control method thereof, and more particularly, relates to a boiler that enables simultaneous use of heating and hot-water without stopping the heating even when the simultaneous use of the heating and the hot-water is requested, and a control method thereof.

BACKGROUND ART

Boilers are used for heating or hot-water in general homes, public buildings, or the like. In general, a boiler performs combustion through a burner by using as oil or gas as a fuel, heats water by using heat of combustion generated in the combustion process, and circulates the heated water indoors to perform heating or use the heated water as hot-water according to necessity.

A conventional combined heating and hot-water boiler 1 is illustrated in FIG. 1. The conventional combined heating and hot-water boiler 1 may include a main heat exchanger 2 that heats heating-water by heat of combustion of a burner, a three-way valve 4 that switches a flow path to a heating mode or a hot-water mode, a boiler circulation pump 5 that circulates water, and a hot-water heat exchanger 3 for supplying hot-water by heat exchange of raw water.

The conventional combined heating and hot-water boiler 1 operates the boiler circulation pump 5 to circulate heating-water to the main heat exchanger 2 through heating-water circulation pipes L1 and L2 and supplies water heated in the main heat exchanger 2 to the three-way valve through a connecting pipe L3. In a heating operation, the three-way valve 4 is switched toward a heating-water supply pipe L4, and the heating-water heat-exchanged by the heat of combustion of the burner is supplied to a site to be heated. When hot-water is used, the three-way valve 4 is switched toward a connecting pipe L5 passing through the hot-water heat exchanger 3, raw water supplied from a raw water pipe L6 is heated into hot-water by heat exchange, and the hot-water is released to a hot-water pipe L7. In FIG. 1, the dash-dot-dash line represents a flow of water in the heating operation, and the dotted line represents a flow of water when hot-water is used.

As described above, in the conventional combined heating and hot-water boiler 1, a heating flow path and a hot-water flow path are distinguished from each other by the three-way valve 4, and the heating operation and the hot-water generating operation are separately performed.

However, because the conventional boiler 1 preferentially performs the hot-water generating operation when hot-water is used, the boiler 1 stops heating and performs the hot-water generating operation when hot-water is used during heating and performs the heating operation after completing the use of hot-water when a request for heating is received while hot-water is used.

Accordingly, when hot-water is used, the heating operation cannot be performed, and therefore there is a problem that heating is not performed well. Furthermore, in the case of the boiler 1 having hot-water standby time to reduce a hot-water temperature deviation and rapidly supply hot-water when hot-water is reused after the use of the hot-water, the heating operation cannot be performed for the hot-water standby time, and therefore heating may not be performed better. Due to these problems, in the case of homes or shops such as restaurants where hot-water is frequently used, a heating device and a hot-water device are separately used in many cases.

In addition, in the case of using the conventional combined heating and hot-water boiler 1, when hot-water is used while heating is used, a problem may arise in which the hot-water is used in a state in which heating supply temperature is high, so that the hot-water is supplied at too high a temperature.

DISCLOSURE

Technical Problem

The present disclosure has been made to solve the above-mentioned problems. An aspect of the present disclosure provides a combined heating and hot-water boiler for stably performing a hot-water generating operation and a heating operation at the same time, and a control method thereof.

Another aspect of the present disclosure provides a combined heating and hot-water boiler for solving a problem that the temperature of hot-water is raised due to simultaneous performance of a heating operation and a hot-water generating operation and supplying hot-water at an appropriate temperature, and a control method thereof.

Technical Solution

A combined heating and hot-water boiler according to the present disclosure includes a main heat exchanger that heats heating-water by heat exchange, a hot-water heat exchanger that is supplied with the heating-water heated in the main heat exchanger and that heats raw water into hot-water by heat exchange with the heating-water, and a controller that controls a flow of the heating-water passing through the hot-water heat exchanger to control formation of at least one of a first flow path along which the heating-water passing through the hot-water heat exchanger is supplied to an object to be heated or a second flow path along which the heating-water passing through the hot-water heat exchanger is supplied to the main heat exchanger.

A method for controlling a combined heating and hot-water boiler according to the present disclosure includes a flow path formation step of forming at least one of a first flow path along which heating-water passing through a hot-water heat exchanger is supplied to an object to be heated or a second flow path along which the heating-water passing through the hot-water heat exchanger is supplied to a main heat exchanger, in consideration of temperature of the heating-water passing through the hot-water heat exchanger when a simultaneous operation of heating and hot-water generation is requested, a heating temperature adjustment step of controlling a heating value of a burner such that the heating-water passing through the hot-water heat exchanger reaches a preset heating temperature, and a hot-water temperature adjustment step of making an adjustment such that temperature of hot-water generated by being heat-exchanged in the hot-water heat exchanger reaches a preset hot-water temperature.

Advantageous Effects

In the combined heating and hot-water boiler and the control method thereof according to the present disclosure, the flow paths are formed such that all of the heating-water heated in the main heat exchanger is supplied to the hot-water heat exchanger and thereafter the heating-water is supplied to a heating device or circulated to the main heat exchanger. Accordingly, the hot-water generating operation and the heating operation may be stably performed at the same time.

In addition, according to the present disclosure, the mixing valve may solve the problem that the temperature of hot-water is raised due to simultaneous performance of a heating operation and a hot-water generating operation and may enable the supply of hot-water at an appropriate temperature.

MODE FOR INVENTION

Hereinafter, exemplary embodiments of the present disclosure will be described in detail with reference to the accompanying drawings.

First, the embodiments to be described below are embodiments appropriate for the understanding of technical features of a combined heating and hot-water boiler and a control method thereof according to the present disclosure. However, the present disclosure is not restrictively applied to the embodiments to be described below, and technical features of the present disclosure are not limited by the embodiments to be described. Furthermore, various changes and modifications can be made without departing from the spirit and scope of the present disclosure.

Figure 14:
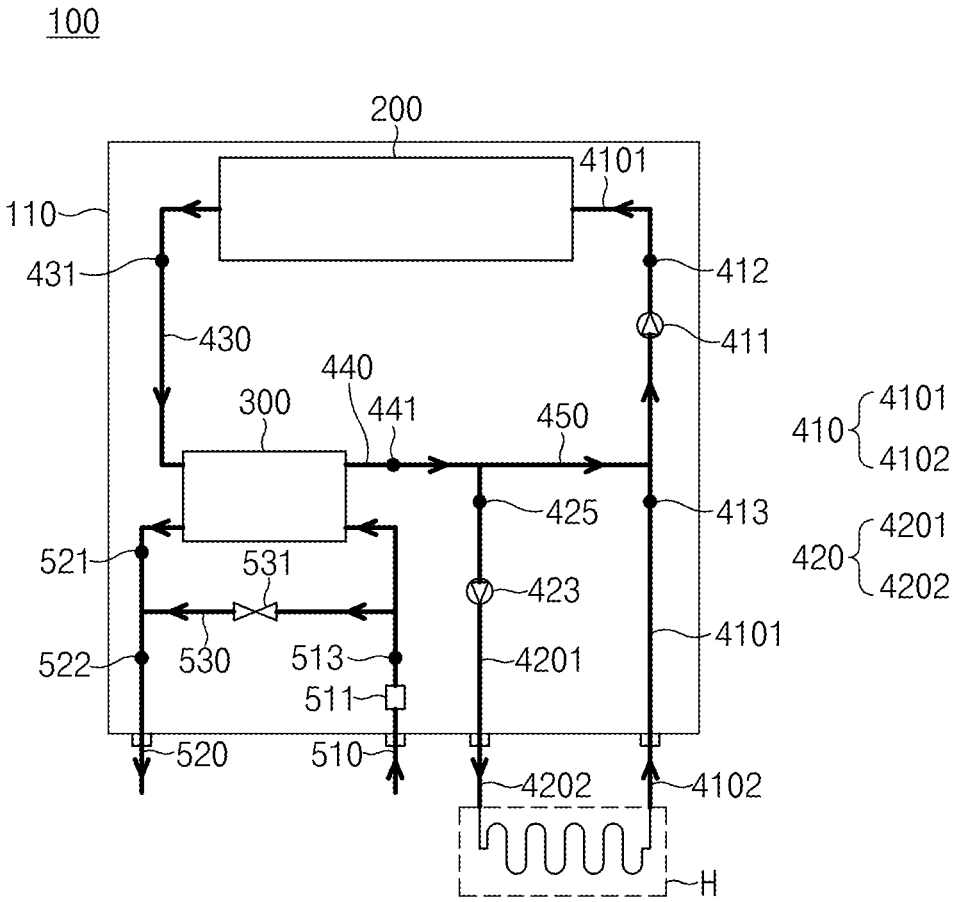
FIG. 14 is a view illustrating a simultaneous operation state of heating and hot-water generation of FIG. 9.
Figure 15:
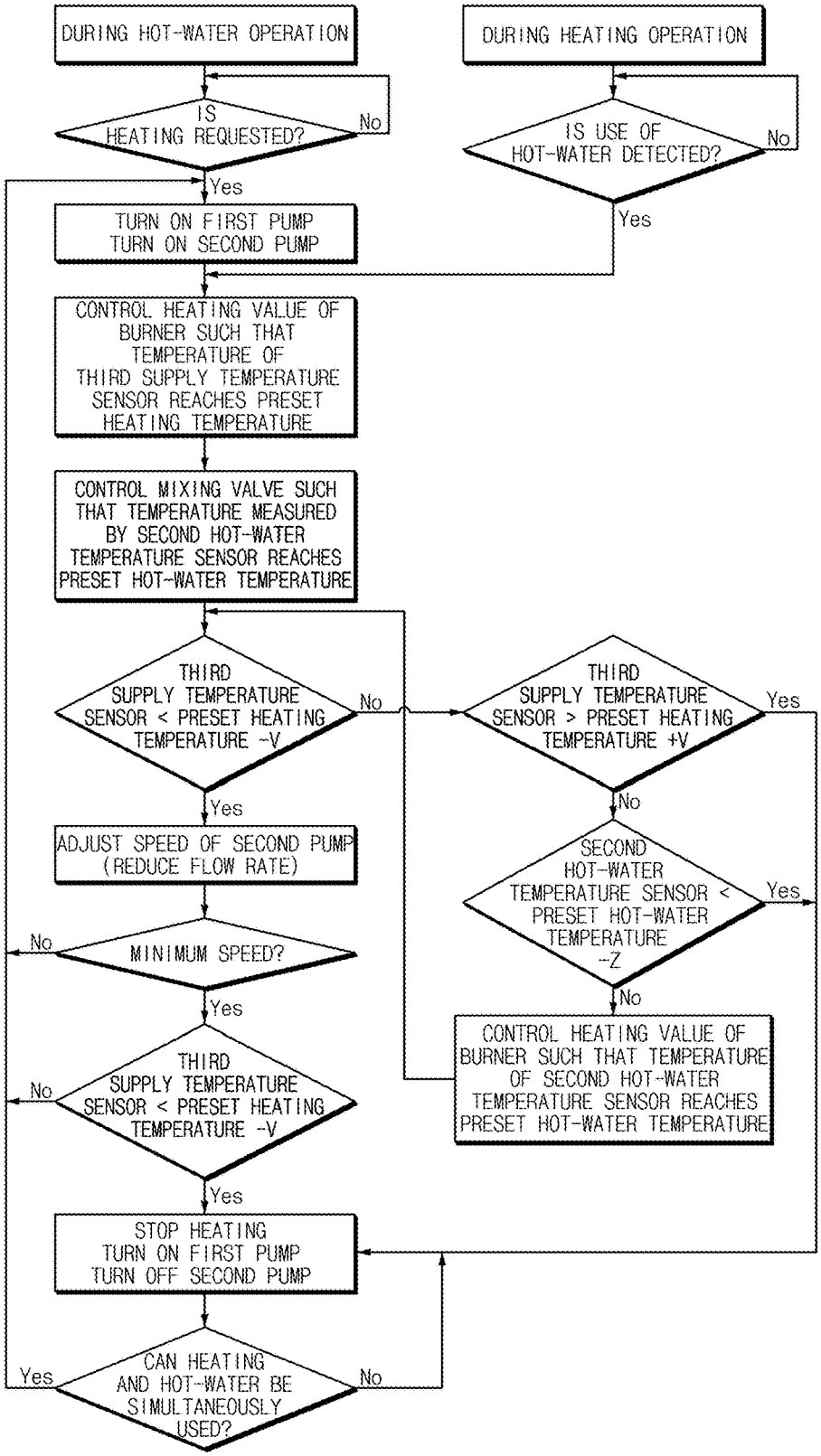
FIG. 15 is a flowchart of a simultaneous operation of heating and hot-water generation of FIG. 9.
Figure 16:
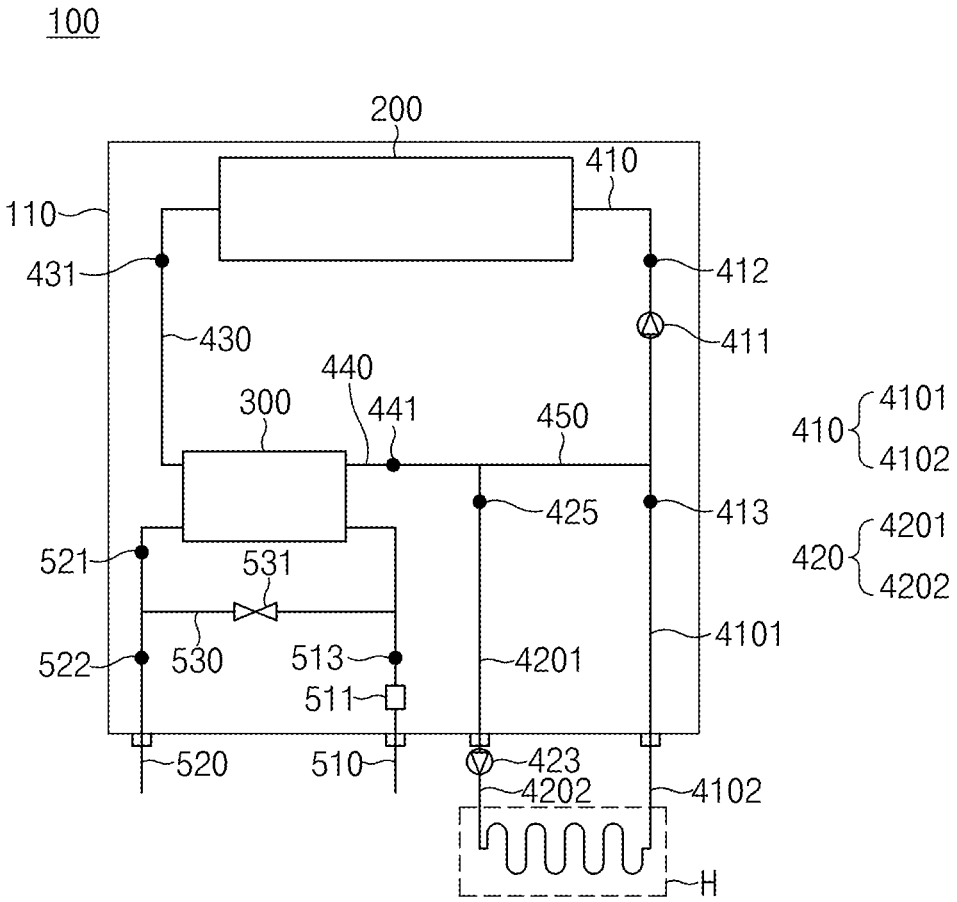
FIG. 16 is a view illustrating a state in which a first pump in FIG. 9 is installed outside a boiler body.
Figure 17:
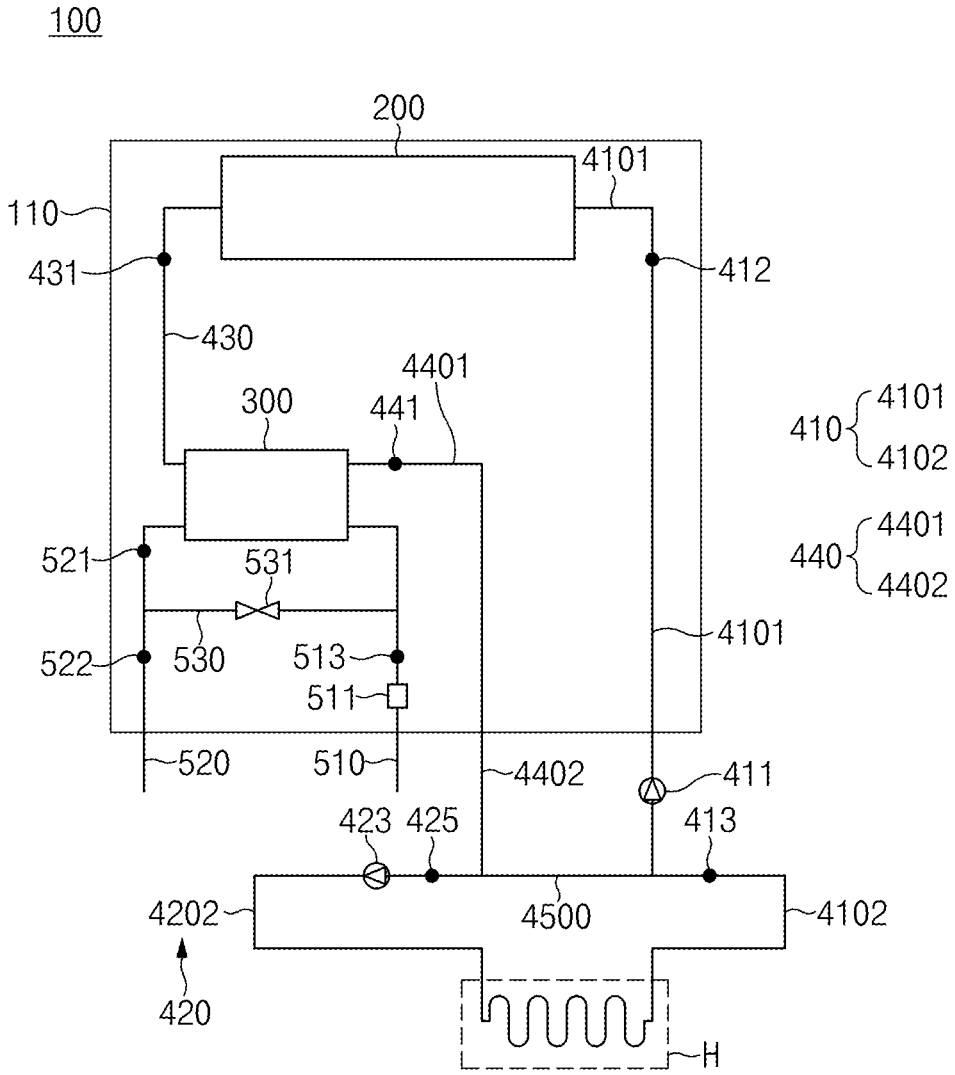
FIG. 17 is a view illustrating a state in which the first pump and a second pump in FIG. 9 are installed outside the boiler body.

A first embodiment of the combined heating and hot-water boiler according to the present disclosure is illustrated in FIGS. 2 to 8, a second embodiment of the combined heating and hot-water boiler according to the present disclosure is illustrated in FIGS. 9 to 15, and modified examples of the second embodiment of the present disclosure are illustrated in FIGS. 16 and 17.

First Embodiment

Figure 1:
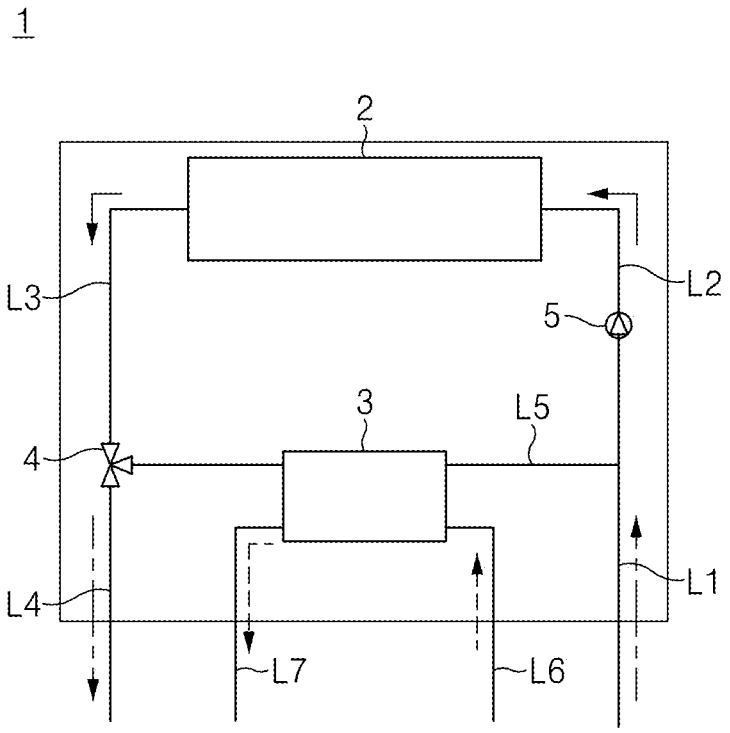
PRIOR ART FIG.1
FIG. 1 is a schematic view illustrating a configuration of a conventional combined heating and hot-water boiler.
Figure 2:
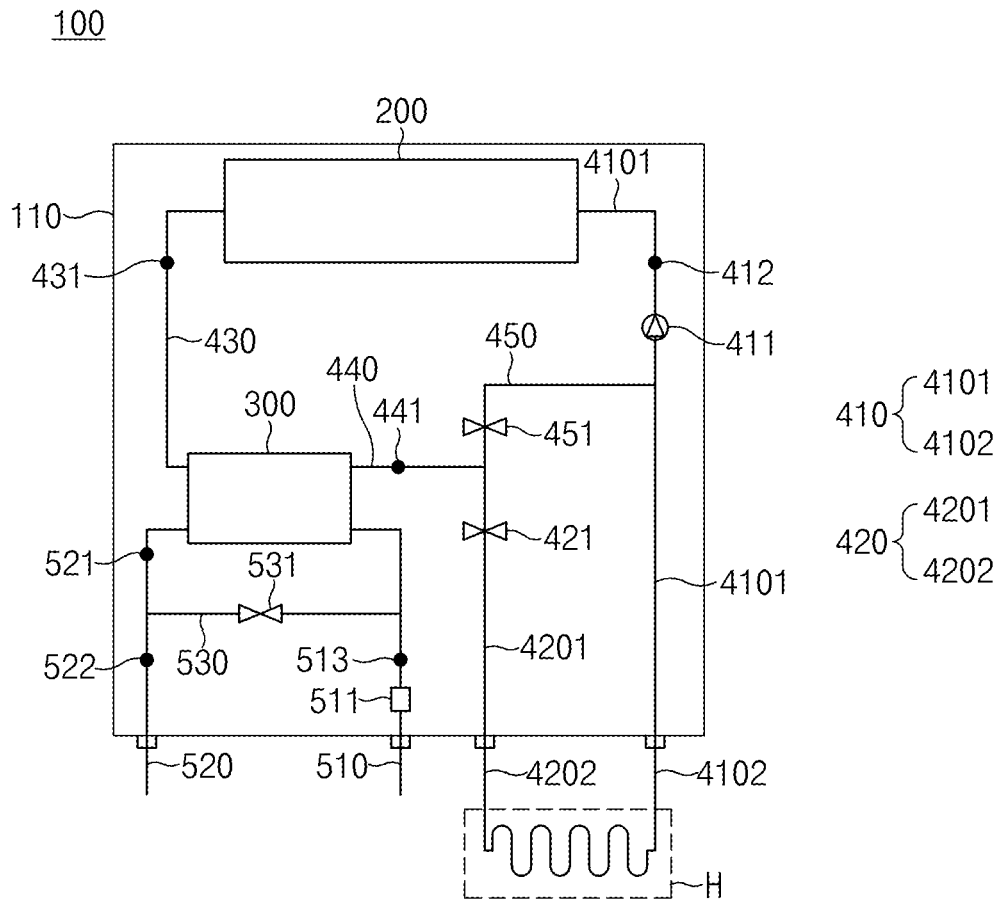
FIG. 2 is a view illustrating a configuration of a combined heating and hot-water boiler according to a first embodiment of the present disclosure.

Referring to FIG. 2, the combined heating and hot-water boiler 100 according to the first embodiment of the present disclosure includes a main heat exchanger 200, a hot-water heat exchanger 300, and a controller.

The main heat exchanger 200 may heat heating-water by heat exchange. Specifically, circulated heating-water may be introduced into the main heat exchanger 200, and the introduced heating-water may be heated by being heat-exchanged by heat of combustion caused by a burner.

The hot-water heat exchanger 300 is supplied with the heating-water heated in the main heat exchanger 200 and heats raw water into hot-water by heat exchange with the heating-water. At this time, all of the heating-water heat-exchanged in the main heat exchanger 200 may be supplied to the hot-water heat exchanger 300.

The controller controls a flow of the heating-water passing through the hot-water heat exchanger 300 to control formation of at least one of a first flow path for supplying the heating-water passing through the hot-water heat exchanger to an object H to be heated or a second flow path for supplying the heating-water passing through the hot-water heat exchanger to the main heat exchanger 200.

Specifically, in the present disclosure, all of the heating-water heated by being heat-exchanged in the main heat exchanger 200 may be supplied to the hot-water heat exchanger 300. The heating-water supplied to the hot-water heat exchanger 300 may exchange heat with the raw water and may thereafter pass through the hot-water heat exchanger 300. The heating-water passing through the hot-water heat exchanger 300 may be supplied to the object H to be heated and/or the main heat exchanger 200 under the control of the controller.

More specifically, the controller may control the flow of the heating-water passing through the hot-water heat exchanger 300 to form the first flow path for supplying the heating-water to the object H to be heated. At this time, a heating operation and a hot-water generating operation may be simultaneously performed because the heating-water heated in the main heat exchanger 200 passes through the hot-water heat exchanger 300 and is thereafter supplied to the object H to be heated. That is, the heating operation may be stably performed while the hot-water is used (refer to FIGS. 3 and 7).

Furthermore, the controller may control the flow of the heating-water passing through the hot-water heat exchanger 300 to form the second flow path for supplying the heating-water to the main heat exchanger 200. In this case, the heating-water may be circulated from the hot-water heat exchanger 300 to the main heat exchanger 200 and may perform the hot-water generating operation (refer to FIG. 5).

As described above, according to the present disclosure, the controller forms the first flow path not only to enable simultaneous use of heating and hot-water and but also to allow the heating operation to be stably performed even while hot-water is used, thereby solving the problems of the boiler in the related art that is focused on hot-water. In addition, in the present disclosure, the controller controls the flow of the heating-water to form the first flow path and the second flow path, thereby appropriately responding to a preset heating temperature and a preset hot-water temperature.

Referring to FIG. 2, the present disclosure may further include a heating-water circulation pipe 410, a first connecting pipe 430, and a second connecting pipe 440.

The heating-water circulation pipe 410 may circulate the heating-water to the main heat exchanger 200. Furthermore, a heating-water supply pipe 420 may be connected with the object H to be heated and may supply the heated heating-water to the object H to be heated. Here, the heating-water circulation pipe 410 may be provided with a first pump 411 and may further be provided with a first circulated-water temperature sensor 412 that is provided in front of the main heat exchanger 200 and that measures the temperature of the heating-water circulated to the main heat exchanger 200.

The heating-water supply pipe 420 may be connected to the object H to be heated to supply the heating-water and may be connected to a downstream side of the second connecting pipe 440. The heating-water heat-exchanged in the hot-water heat exchanger 300 may be released to the heating-water supply pipe 420 through the second connecting pipe 440.

The first connecting pipe 430 may connect the main heat exchanger 200 and the hot-water heat exchanger 300 and may supply all of the heating-water heat-exchanged in the main heat exchanger 200 to the hot-water heat exchanger 300. That is, the formation of a flow path that allows all of the heating-water heat-exchanged in the main heat exchanger 200 to be supplied to the hot-water heat exchanger 300 may be implemented by the first connecting pipe 430. Here, the first connecting pipe 430 may be provided with a first supply temperature sensor 431 that measures the temperature of the heating-water heat-exchanged in the main heat exchanger 200. Furthermore, an expansion tank may be disposed on the heating-water circulation pipe 410 in front of the main heat exchanger 200 or the first connecting pipe 430 behind the main heat exchanger 200.

The heating-water heat-exchanged in the hot-water heat exchanger 300 may be released to the second connecting pipe 440. Here, the second connecting pipe 440 may be provided with a second supply temperature sensor 441 that measures the temperature of the heating-water passing through the hot-water heat exchanger 300.

A third connecting pipe 450 may connect the second connecting pipe 440 and the heating-water circulation pipe 410. The third connecting pipe 450 may supply the heating-water introduced through the second connecting pipe 440 to the heating-water circulation pipe 410 to supply the heating-water to the main heat exchanger 200. Here, the heating-water circulation pipe 410 may further include a second circulated-water temperature sensor 413 that is provided upstream of a connection point between the third connecting pipe 450 and the heating-water circulation pipe 410 and that measures the temperature of the heating-water circulated from the object H to be heated.

Here, referring to the illustrated embodiment, the present disclosure may further include a boiler body 110 in which the main heat exchanger 200 and the hot-water heat exchanger 300 are received. The heating-water circulation pipe 410 may include at least one of an internal heating-water circulation pipe 4101 that is provided inside the boiler body 110 and is connected to the main heat exchanger 200 or an external heating-water circulation pipe 4102 that is provided outside the boiler body 110 and is connected to the object H to be heated and that extends from the internal heating-water circulation pipe 4101. The heating-water circulation pipe 410 may be directly or indirectly connected to the object H to be heated.

Furthermore, the heating-water supply pipe 420 may include at least one of an internal heating-water supply pipe 4201 that is provided inside the boiler body 110 and is connected with the second connecting pipe 440 or an external heating-water supply pipe 4202 that is provided outside the boiler body 110 and is connected to the object H to be heated and that extends from the internal heating-water supply pipe 4201. For example, as illustrated, the heating-water supply pipe 420 may include both the internal heating-water supply pipe 4201 and the external heating-water supply pipe 4202, and although not illustrated, the heating-water supply pipe 420 may include only one of the internal heating-water supply pipe 4201 and the external heating-water supply pipe 4202. The heating-water supply pipe 420 may be directly or indirectly connected to the object H to be heated.

As in the embodiment illustrated in FIG. 2, the entire second connecting pipe 440 may be provided inside the boiler body 110. Alternatively, as in the embodiment illustrated in FIG. 17, the second connecting pipe 440 may include a second internal connecting pipe 4401 that is provided inside the boiler body 110 and is connected to the hot-water heat exchanger 300 and a second external connecting pipe 4402 that is provided outside the boiler body 110 and that extends from the second internal connecting pipe 4401.

The third connecting pipe 450 may be provided inside or outside the boiler body 110 depending on the positions of the second connecting pipe 440 and the heating-water circulation pipe 410.

The controller may form the first flow path by allowing the heating-water passing through the hot-water heat exchanger 300 to flow to the second connecting pipe 440 and the heating-water supply pipe 420. Furthermore, the controller may form the second flow path by allowing the heating-water passing through the hot-water heat exchanger 300 to flow downstream through the second connecting pipe 440, the third connecting pipe 450, and the heating-water circulation pipe 410.

At this time, the first flow path may be implemented in various forms as long as the first flow path is capable of supplying the heating-water passing through the hot-water heat exchanger 300 to the object H to be heated. For example, in a case where a separate water inlet pipe (not illustrated) is installed on the object H to be heated and the external heating-water supply pipe 4202 is connected to the water inlet pipe, the first flow path may be implemented to include the second connecting pipe 440, the heating-water supply pipe 420, and the water inlet pipe provided on the object H to be heated.

Due to the configuration described above, the present disclosure may perform a simultaneous operation of heating and hot-water generation. Specifically, in the simultaneous operation of heating and hot-water generation, the controller may form at least one of the first flow path or the second flow path depending on the temperature of the heating-water released to the second connecting pipe 440.

Furthermore, in the simultaneous operation of heating and hot-water generation, the controller may control the heating value of the burner that transfers heat of combustion to the main heat exchanger 200, such that the temperature of the heating-water released to the second connecting pipe 440 reaches the preset heating temperature.

Specifically, in the simultaneous operation of heating and hot-water generation, the controller may control the heating value of the burner such that the temperature of the second connecting pipe 440 reaches the preset heating temperature. That is, the temperature of the first supply temperature sensor 431 may be set in consideration of the temperature of the second supply temperature sensor 441 and heat exchange in the hot-water heat exchanger 300. In a case where the temperature of the second supply temperature sensor 441 deviates from the preset heating temperature depending on heating and the use of hot-water, the controller may stably maintain heating temperature by adjusting the amount of heating-water supplied to the first flow path or forming the second flow path.

Meanwhile, the present disclosure may include a raw water pipe 510 and a hot-water pipe 520. In addition, the present disclosure may further include a mixing pipe 530 and a mixing valve 531. Raw water to be heat-exchanged in the hot-water heat exchanger 300 may be supplied to the raw water pipe 510, and first hot-water heat-exchanged in the hot-water heat exchanger 300 may be released to the hot-water pipe 520.

Here, as the temperature of the heating-water released to the second connecting pipe 440 is set to the preset heating temperature, the temperature of the first hot-water heat-exchanged in the hot-water heat exchanger 300 and released to the hot-water pipe 520 may be higher than a hot-water temperature set in response to a request from a user. Accordingly, to solve this problem, the present disclosure may further include the mixing pipe 530 and the mixing valve 531.

The mixing pipe 530 may be connected between the raw water pipe 510 and the hot-water pipe 520, and the mixing valve 531 may be installed on the mixing pipe 530 and may adjust the amount of raw water to be mixed. Here, the raw water pipe 510 may be provided with a raw water temperature sensor 513 that measures the temperature of the raw water introduced and a flow-rate detection sensor 511 that measures the flow rate of the raw water introduced.

The hot-water pipe 520 may be provided with a first hot-water temperature sensor 521 and a second hot-water temperature sensor 522. The first hot-water temperature sensor 521 may be provided upstream of a connection point between the hot-water pipe 520 and the mixing pipe 530 and may measure the temperature of the first hot-water that is hot-water immediately after heat exchange in the hot-water heat exchanger 300. The second hot-water temperature sensor 522 may be provided on the hot-water pipe 520 downstream of the connection point between the hot-water pipe 520 and the mixing pipe 530 and may measure the temperature of second hot-water that is hot-water released.

The controller may adjust the mixing valve 531 such that the temperature of the second hot-water released to the outside through the hot-water pipe 520 reaches the preset hot-water temperature. Specifically, the controller may adjust the mixing valve 531 in consideration of the temperature sensed by the first hot-water temperature sensor 521 such that the temperature sensed by the second hot-water temperature sensor 522 reaches the preset hot-water temperature.

Accordingly, even in a case where the temperature of the first hot-water is higher than the preset hot-water temperature, the controller may control the mixing valve 531 to appropriately supply the raw water to the first hot-water such that the temperature of the second hot-water reaches the preset hot-water temperature. That is, the controller may control the opening degree of the mixing valve 531 by comparing the temperature of the raw water temperature sensor 513 installed on the raw water pipe, the temperature of the first hot-water temperature sensor 521, and the hot-water temperature set by the user.

Accordingly, according to the present disclosure, the mixing valve 531 may solve the problem that the temperature of hot-water is raised due to simultaneous performance of a heating operation and a hot-water generating operation and may supply hot-water at an appropriate temperature.

Referring to FIG. 2, the first embodiment of the present disclosure may include a heating valve 421 and a hot-water valve 451.

The heating valve 421 may be installed on the heating-water supply pipe 420 and may open and close the heating-water supply pipe 420. The hot-water valve 451 may be installed on the third connecting pipe 450 and may open and close the third connecting pipe 450. Here, the heating valve 421 and the hot-water valve 451 may be opening-degree-adjustable valves and may be opening/shutting valves of an on/off type.

Figure 3:
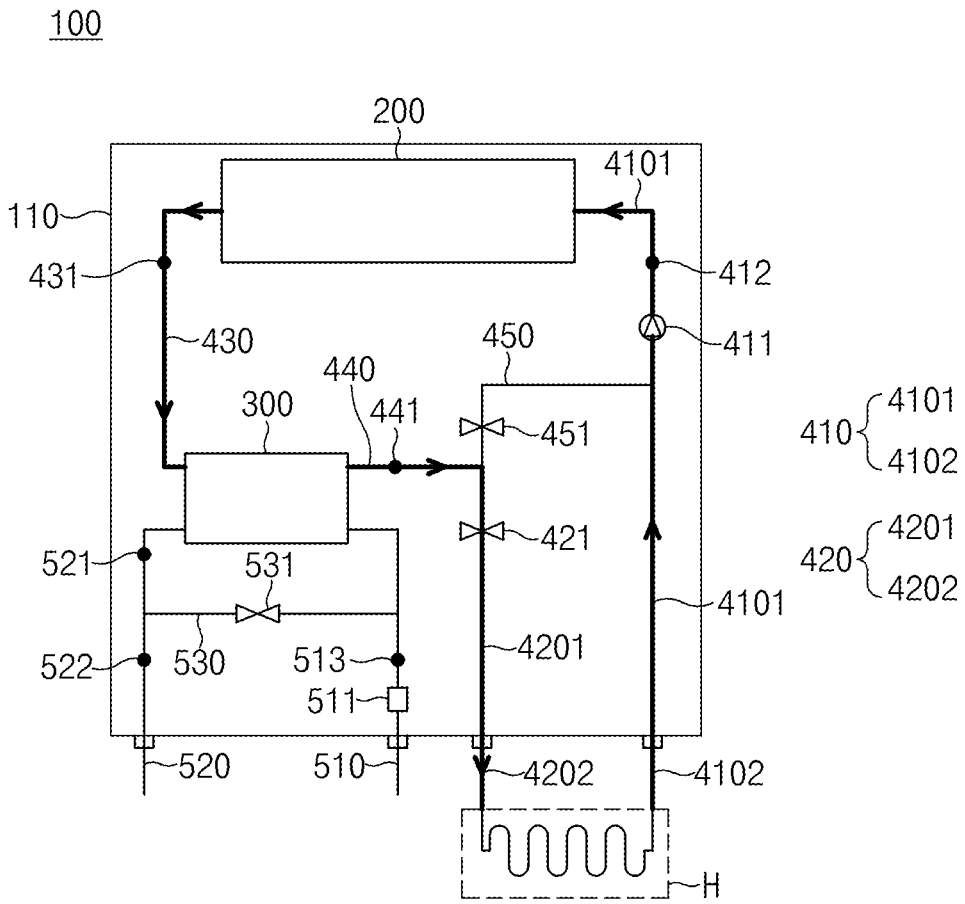
FIG. 3 is a view illustrating a heating operation state of FIG. 2.
Figure 4:
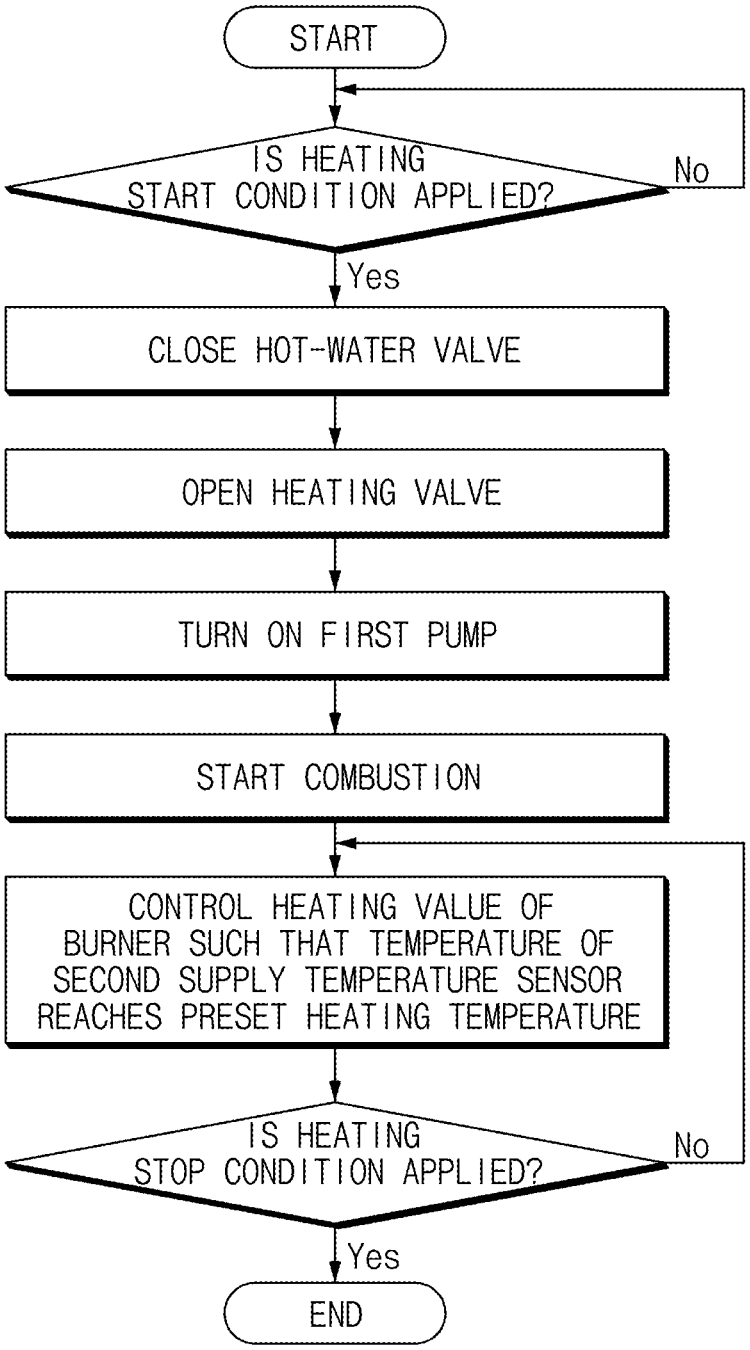
FIG. 4 is a flowchart of a heating operation of FIG. 2.

FIG. 3 is a view illustrating a heating operation state using the first embodiment, and FIG. 4 is a flowchart of a heating operation.

Referring to FIG. 3, the controller may perform control to close the hot-water valve 451 and open the heating valve 421 to form the first flow path in the heating operation.

Specifically, when the heating operation is requested, the hot-water valve 451 may be closed by the controller, and the heating valve 421 may be opened by the controller. At this time, heating-water passing through the hot-water heat exchanger 300 may flow through the second connecting pipe 440 and the heating-water supply pipe 420 and may be supplied to the object H to be heated. When the first pump 411 installed on the heating-water circulation pipe 410 is operated, the heating-water may be supplied from the object H being heated to the main heat exchanger 200, the heating-water heated in the main heat exchanger 200 may be supplied to the hot-water heat exchanger 300, and a circulation flow path including the object H being heated may be formed.

Figure 5:
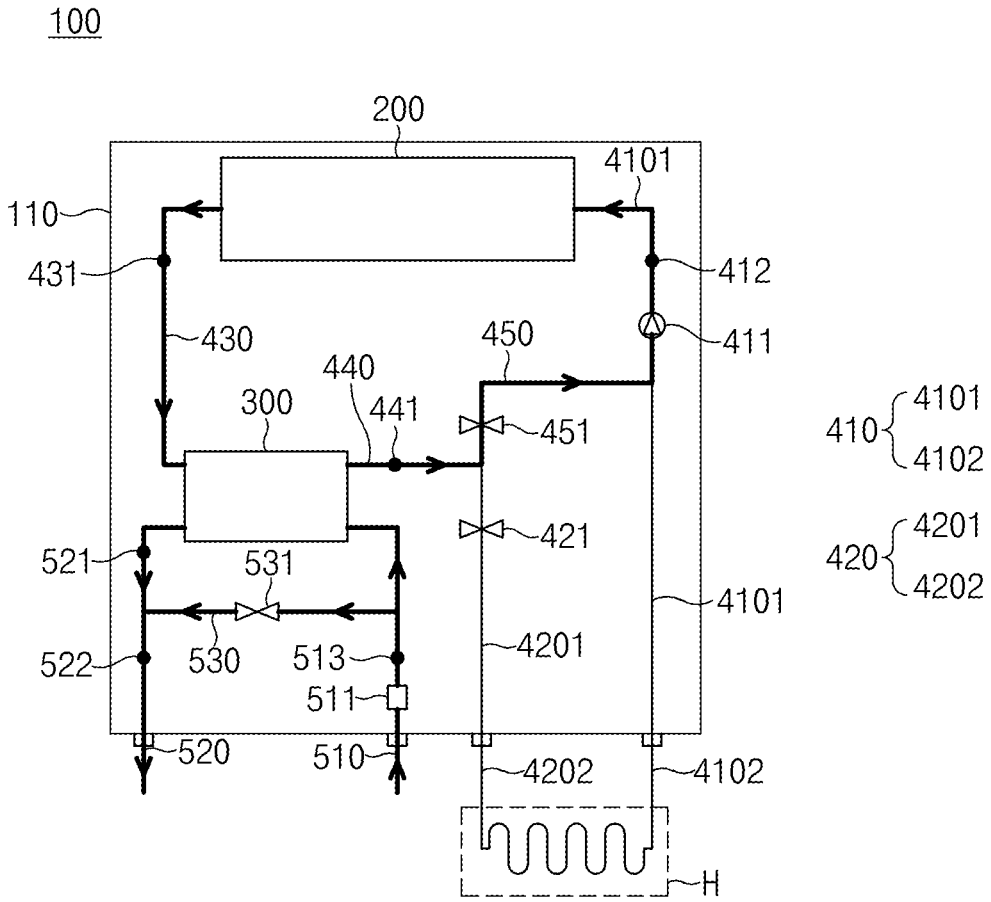
FIG. 5 is a view illustrating a hot-water generating operation state of FIG. 2.
Figure 6:
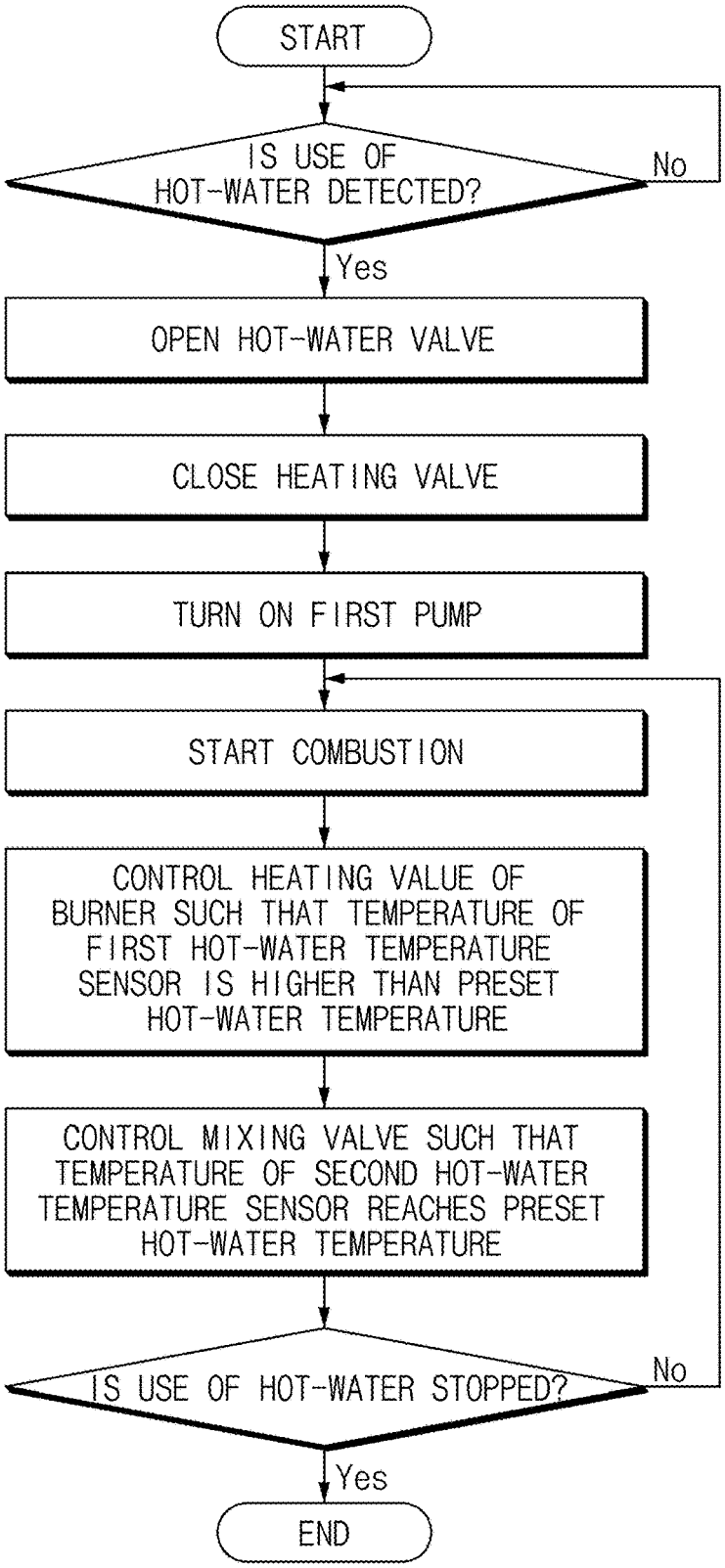
FIG. 6 is a flowchart of a hot-water generating operation of FIG. 2.

FIG. 5 is a view illustrating a hot-water generating operation state using the first embodiment, and FIG. 6 is a flowchart of a hot-water generating operation.

Referring to FIGS. 5 and 6, the controller may perform control to close the heating valve 421 and open the hot-water valve 451 to form the second flow path in the hot-water generating operation.

Specifically, when the hot-water generating operation is requested, the heating valve 421 may be closed by the controller, and the hot-water valve 451 may be opened by the controller. At this time, heating-water passing through the hot-water heat exchanger 300 may flow downstream through the second connecting pipe 440, the third connecting pipe 450, and the heating-water circulation pipe 410 and may be supplied to the main heat exchanger 200. The heating-water heated in the main heat exchanger 200 may be supplied to the hot-water heat exchanger 300, and a circulation flow path along which the heating-water circulates may be formed between the hot-water heat exchanger 300 and the main heat exchanger 200.

Figure 7:
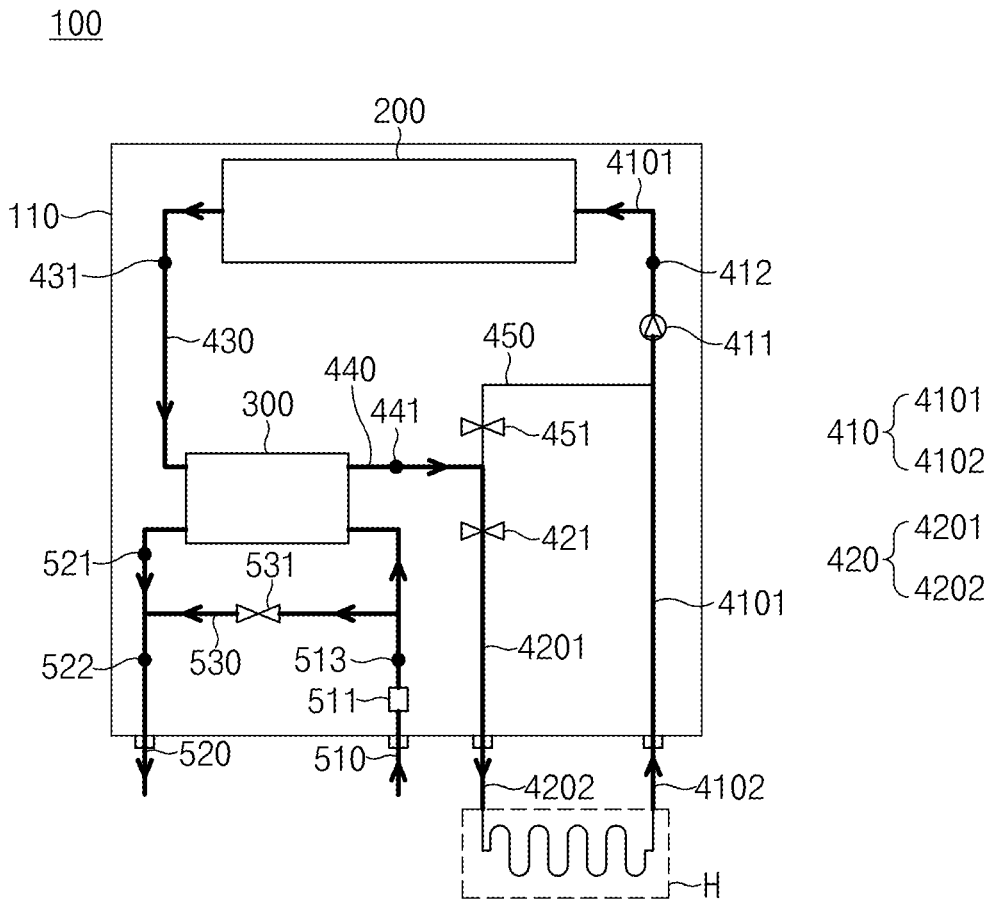
FIG. 7 is a view illustrating a simultaneous operation state of heating and hot-water generation of FIG. 2.
Figure 8:
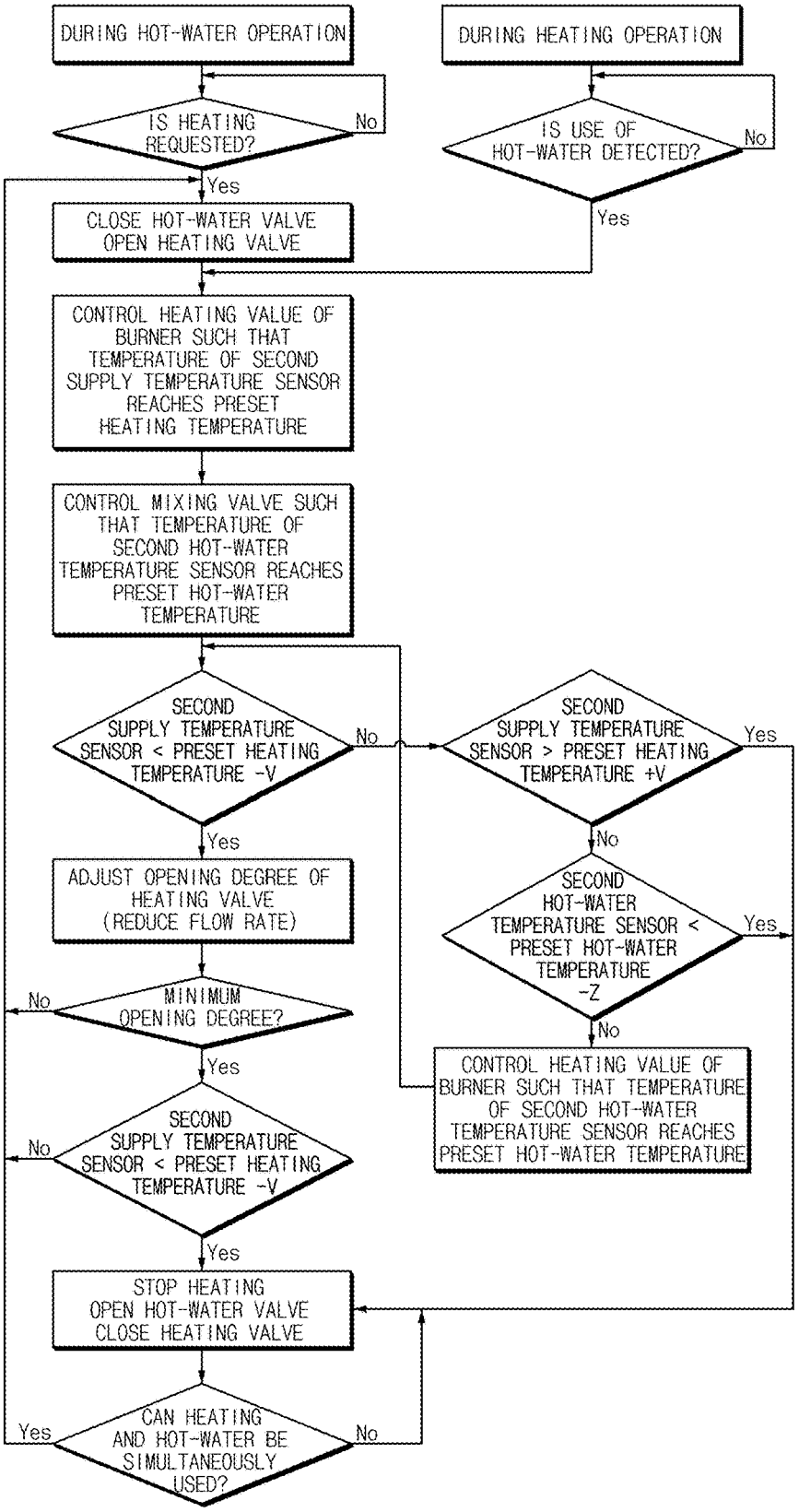
FIG. 8 is a flowchart of a simultaneous operation of heating and hot-water generation of FIG. 2.

FIG. 7 is a view illustrating a simultaneous operation state of heating and hot-water generation using the first embodiment, and FIG. 8 is a flowchart of a simultaneous operation of heating and hot-water generation.

As described above, in the simultaneous operation of heating and hot-water generation, the controller may form at least one of the first flow path or the second flow path depending on the temperature of heating-water released to the second connecting pipe 440. Furthermore, the controller may control the heating value of the burner that transfers heat of combustion to the main heat exchanger 200, such that the temperature of the heating-water released to the second connecting pipe 440 reaches the preset heating temperature.

Referring to FIGS. 7 and 8, in the first embodiment, the controller may perform control to close the hot-water valve 451 and open the heating valve 421 to form the first flow path and may thereafter control the hot-water valve 451 and the heating valve 421 to form the second flow path in consideration of the temperature of the heating-water released to the second connecting pipe 440.

Specifically, when the simultaneous operation is requested, the hot-water valve 451 may be closed by the controller, the heating valve 421 may be opened by the controller, and the first flow path may be formed. When the first pump 421 is operated, the heating-water supplied to the object H being heated flows to the main heat exchanger 200 through the heating-water circulation pipe 410, the heating-water flows to the hot-water heat exchanger 300 through the first connecting pipe 430, and the heating-water flows, through the second connecting pipe 440 and the heating-water supply pipe 420, to the object H being heated.

At this time, the temperature of the second connecting pipe 440 may be controlled in consideration of the heating-water. Thereafter, when the temperature of the second connecting pipe 440 deviates from the preset heating temperature depending on a service load of heating and hot-water, the amount of the heating-water flowing along the first flow path may be adjusted, or the second flow path may be formed, in consideration of the temperature of the heating-water in the second connecting pipe 440. Accordingly, the hot-water generating operation and the heating operation may be stably performed at the same time.

Specifically, referring to FIG. 8, in the simultaneous operation of heating and hot-water generation, in a case where the temperature of the heating-water in the second connecting pipe 440 is lower than the preset heating temperature even though the heating value of the burner is controlled to the maximum, the controller may decrease the flow rate of the heating-water passing through the hot-water heat exchanger 300 by reducing the opening degree of the heating valve 421.

Specifically, in a case where a hot-water service load increases, the temperature of the second supply temperature sensor 441 may be lower than the preset heating temperature even though the burner is operated with a maximum heating value. At this time, the controller may adjust the opening degree of the heating valve 421 such that the temperature of the second supply temperature sensor 441 reaches the preset heating temperature. That is, the controller may reduce the opening degree of the heating valve 421 to decrease the flow rate of the heating-water passing through the hot-water heat exchanger 300, thereby raising the temperature of the heating-water passing through the hot-water heat exchanger 300. Thereafter, when the temperature of the second supply temperature sensor 441 reaches the preset heating temperature, the controller may increase the opening degree of the heating valve 421 again to return the heating valve 421 to the original state.

However, in a case where the temperature of the heating-water in the second connecting pipe 440 (the temperature of the second supply temperature sensor 441) is lower than the preset heating temperature even though the opening degree of the heating valve 421 is reduced to the minimum, the controller may open the hot-water valve 451 to form the second flow path and may close the heating valve 421. At this time, the boiler stops the heating operation and performs only the hot-water generating operation. Thereafter, when the temperature of the second supply temperature sensor 441 reaches the preset heating temperature, the controller may perform the simultaneous operation of heating and hot-water generation again.

For example, in a case where the preset heating temperature requested by the user is 60 degrees Celsius, a heating operation is stopped, and only a hot-water generating operation is performed when the temperature of the second supply temperature sensor 441 is lower than 55 degrees Celsius (a preset heating temperature −v, refer to FIG. 8) although the heating value of the burner is controlled to the maximum and the opening degree of the heating valve 421 is adjusted due to an increase in a hot-water service load in a state in which the temperature of the second supply temperature sensor 441 is controlled to 60 degrees Celsius. In this situation, when the temperature of the second supply temperature sensor 441 is higher than or equal to 55 degrees Celsius due to a decrease in the hot-water service load, the heating operation is performed. Here, "v" in FIG. 8 is an error range.

In contrast, referring to FIG. 8, in the simultaneous operation of heating and hot-water generation, in a case where the temperature of the heating-water in the second connecting pipe 440 (the temperature of the second supply temperature sensor 441) is higher than the preset heating temperature, the controller may perform control to open the hot-water valve 451 and close the heating valve 421 to form the second flow path. This is to prevent the heating operation from being performed at a higher temperature than the preset heating temperature.

Specifically, in a case where a hot-water service load decreases, the temperature of the second supply temperature sensor 441 may be higher than the preset heating temperature. At this time, the controller may perform control to open the hot-water valve 451 and close the heating valve 421 to perform only a hot-water generating operation such that the temperature of the second supply temperature sensor 441 reaches the preset heating temperature. Thereafter, when the temperature of the second supply temperature sensor 441 reaches the preset heating temperature due to an increase in the hot-water service load, the controller may perform control to open the heating valve 421 and close the hot-water valve 451 to perform a heating operation again.

In a case where the preset heating temperature requested by the user is 50 degrees Celsius, a heating operation is stopped, and only a hot-water generating operation is performed when the temperature of the second supply temperature sensor 441 exceeds 55 degrees Celsius (a preset heating temperature +v, refer to FIG. 8) due to a decrease in a hot-water service load in a state in which the temperature of the second supply temperature sensor 441 is controlled to 50 degrees Celsius. When the temperature of the second supply temperature sensor 441 is lower than or equal to 55 degrees Celsius due to an increase in the hot-water service load in this state, the heating operation is performed.

Furthermore, in a case where the temperature of the second hot-water temperature sensor 522 is below an error range of the preset hot-water temperature (a preset hot-water temperature −z, refer to FIG. 8) although the temperature of the second supply temperature sensor 441 is set to the preset heating temperature, a target temperature is raised by controlling the heating value of the burner such that the temperature of the second hot-water temperature sensor 522 is within the error range of the preset hot-water temperature. Here, "z" in FIG. 8 is an error range. Here, the error range is not a fixed value, and the user may adjust the error range through a setting change.

Meanwhile, a method for controlling the combined heating and hot-water boiler according to the first embodiment of the present disclosure will be described below with reference to FIG. 8. The control method of the combined heating and hot-water boiler according to another aspect of the present disclosure, which will be described below, is a control method using the above-described combined heating and hot-water boiler according to the first embodiment of the present disclosure. Accordingly, repetitive descriptions identical to ones given above will be omitted.

The control method of the combined heating and hot-water boiler 100 according to the first embodiment of the present disclosure includes a flow path formation step, a heating temperature adjustment step, and a hot-water temperature adjustment step.

In the flow path formation step, when a simultaneous operation of heating and hot-water generation is requested, at least one of the first flow path for supplying heating-water passing through the hot-water heat exchanger 300 to the object H to be heated or the second flow path for supplying the heating-water passing through the hot-water heat exchanger 300 to the main heat exchanger 200 is formed in consideration of the temperature of the heating-water passing through the hot-water heat exchanger 300.

In the heating temperature adjustment step, the heating value of the burner is controlled such that the heating-water passing through the hot-water heat exchanger 300 reaches the preset heating temperature.

In the hot-water temperature adjustment step, the temperature of hot-water generated by being heat-exchanged in the hot-water heat exchanger 300 is adjusted to reach the preset hot-water temperature.

According to the present disclosure, the heating-water heated in the main heat exchanger 200 is supplied to the hot-water heat exchanger 300, and thereafter the heating-water passing through the hot-water heat exchanger 300 is supplied to a heating device or circulated to the main heat exchanger 200. Accordingly, the hot-water generating operation and the heating operation may be stably performed at the same time.

Second Embodiment

Hereinafter, a combined heating and hot-water boiler 100 according to a second embodiment of the present disclosure will be described with reference to FIGS. 9 to 17. The combined heating and hot-water boiler 100 according to the second embodiment differs from the combined heating and hot-water boiler 100 according to the first embodiment in that a flow of heating-water is controlled by a first pump 411 and a second pump 423 instead of the hot-water valve 451 and the heating valve 421 of the first embodiment, and the remaining configuration is the same as that in the first embodiment. No detailed description of the same configuration will be provided, and the following description will be focused on the difference.

Figure 9:
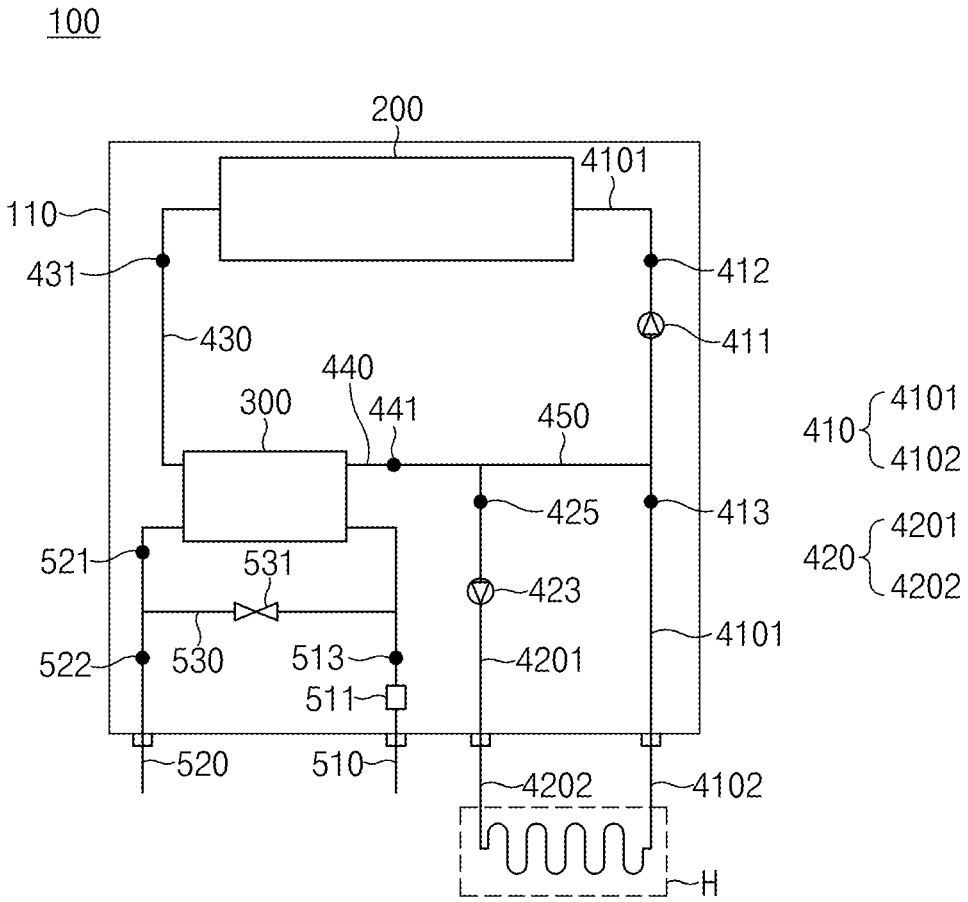
FIG. 9 is a view illustrating a configuration of a combined heating and hot-water boiler according to a second embodiment of the present disclosure.

Referring to FIG. 9, the second embodiment of the present disclosure may include the first pump 411 and the second pump 423.

The first pump 411 may be installed on the heating-water circulation pipe 410 and may circulate the heating-water to the main heat exchanger 200. The second pump 423 may be installed on the heating-water supply pipe 420 and may supply the heating-water in the second connecting pipe 440 to the object H to be heated. Here, there is no limitation in the type of the first pump 411 and the second pump 423. For example, a speed-adjustable pump may be applied, and an on/off type may be applied.

Furthermore, the heating-water supply pipe 420 may be provided with a third supply temperature sensor 425 that measures the temperature of the heating-water that is supplied to the object H to be heated.

Figure 10:
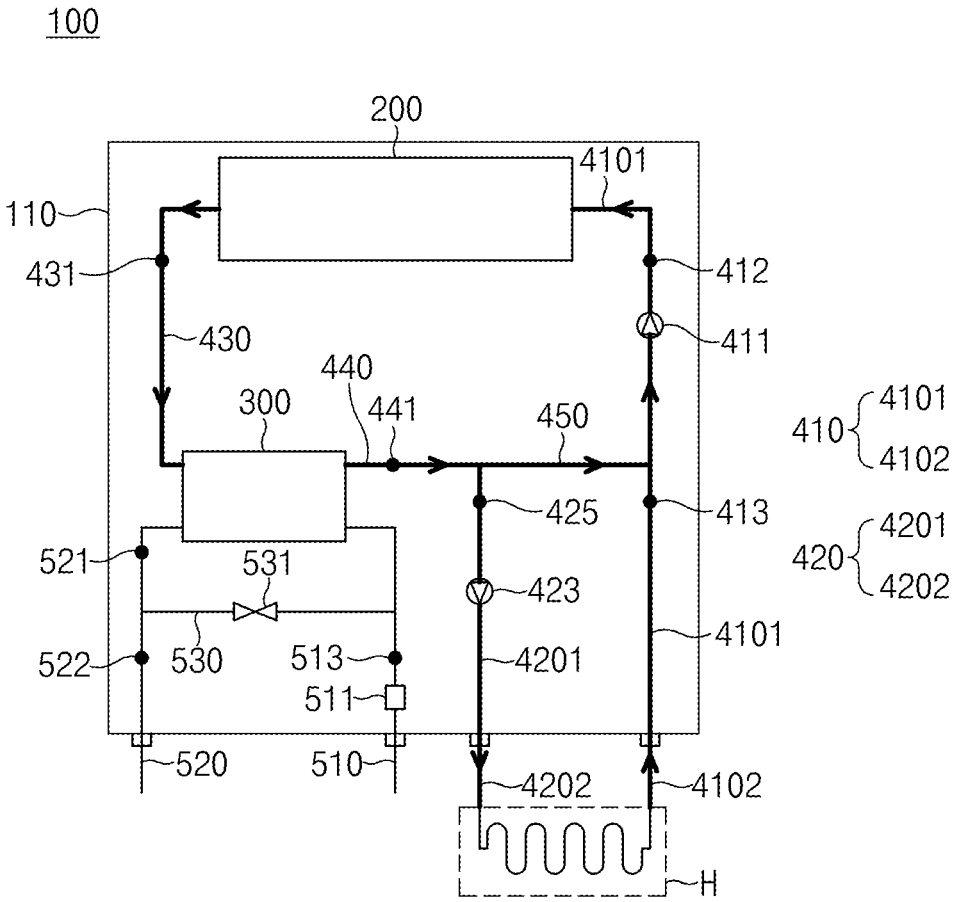
FIG. 10 is a view illustrating a heating operation state of FIG. 9.
Figure 11:
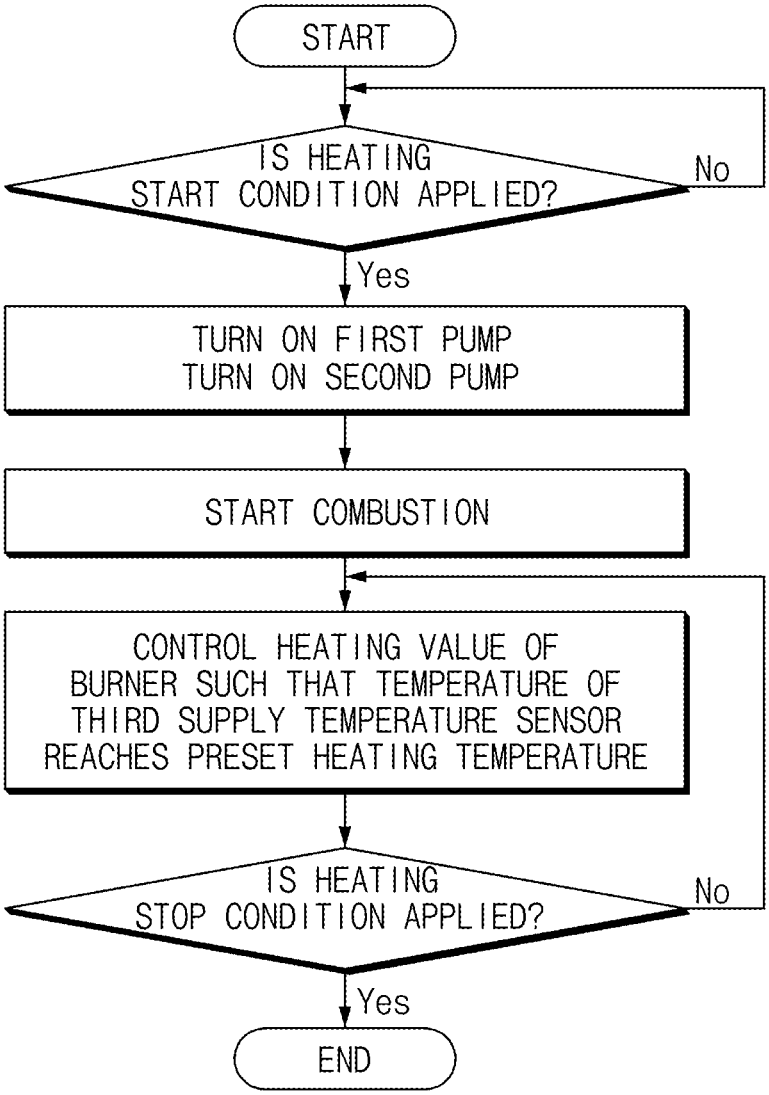
FIG. 11 is a flowchart of a heating operation of FIG. 9.

FIG. 10 is a view illustrating a heating operation state using the second embodiment, and FIG. 11 is a flowchart of a heating operation.

Referring to FIGS. 10 and 11, the controller may perform control to operate the first pump 411 and the second pump 423 to form a first flow path in the heating operation. Specifically, when the heating operation is requested, the first pump 411 and the second pump 423 may be operated by the controller. At this time, heating-water passing through the hot-water heat exchanger 300 may flow through the second connecting pipe 440 and the heating-water supply pipe 420 and may be supplied to the object H to be heated. When the first pump 411 installed on the heating-water circulation pipe 410 is operated, the heating-water may be supplied from the object H being heated to the main heat exchanger 200, the heating-water heated in the main heat exchanger 200 may be supplied to the hot-water heat exchanger 300, and a circulation flow path including the object H being heated may be formed. At this time, the heating-water in the second connecting pipe 440 may be supplied to the heating-water circulation pipe 410 through the third connecting pipe 450.

At this time, the controller may control the heating value of the burner, which is connected to the main heat exchanger 200, such that the temperature of the heating-water supplied to the heating-water supply pipe 420 reaches the preset heating temperature. Here, an outcome of controlling the heating value of the burner of the main heat exchanger 200 may be measured through the first supply temperature sensor 431 installed on the first connecting pipe 430, and the temperature of the heating-water supplied to the heating-water supply pipe 420 may be measured through the third supply temperature sensor 425. Here, in a case where the flow rate of the heating-water supplied from the second connecting pipe 440 to the third connecting pipe 450 is higher than the flow rate of the heating-water supplied from the second connecting pipe 440 to the heating-water supply pipe 420, the temperature of the second supply temperature sensor 441 may be lower than the temperature of the third supply temperature sensor 425. Accordingly, the controller preferably controls the heating value of the burner such that the temperature of the third supply temperature sensor 425 reaches the preset heating temperature.

Figure 12:
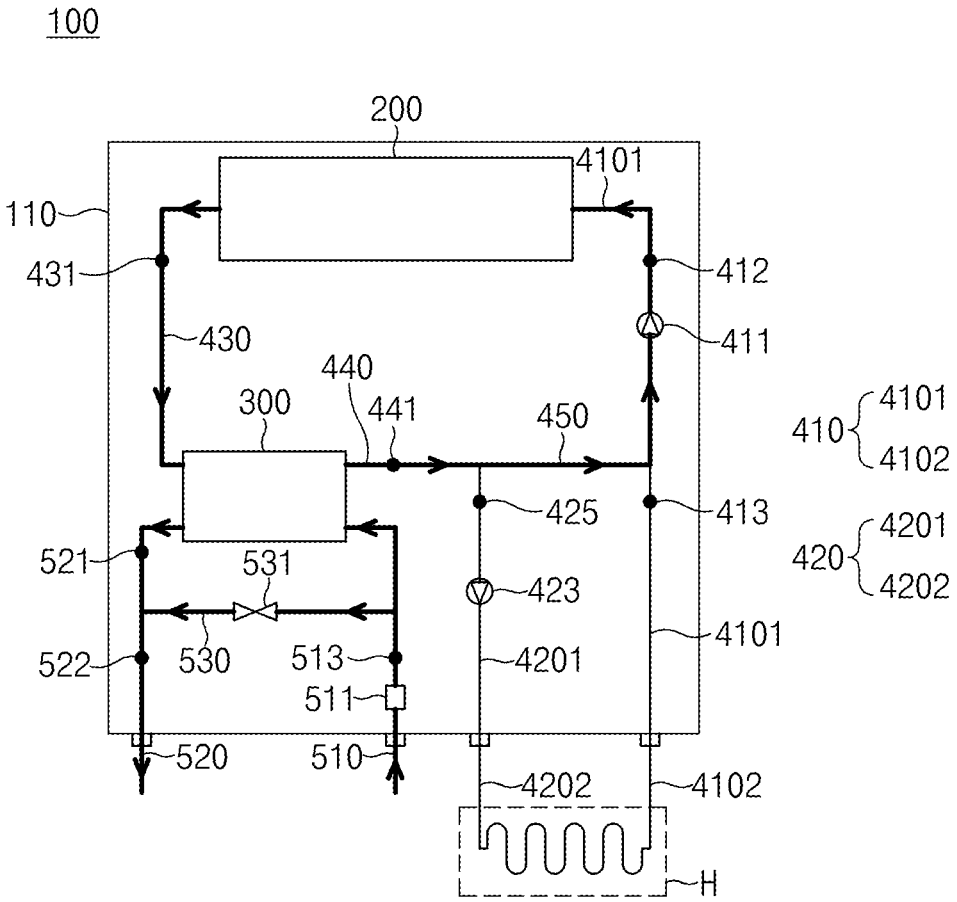
FIG. 12 is a view illustrating a hot-water generating operation state of FIG. 9.
Figure 13:
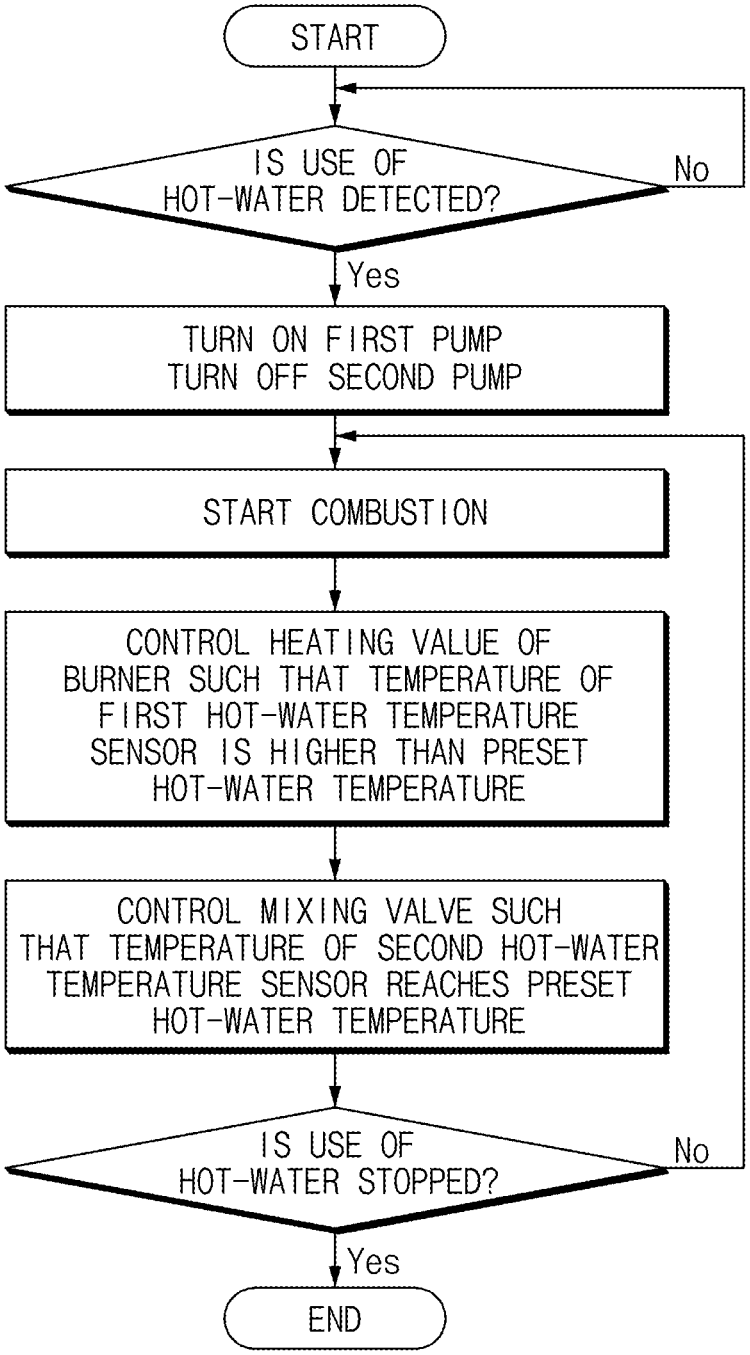
FIG. 13 is a flowchart of a hot-water generating operation of FIG. 9.

FIG. 12 is a view illustrating a hot-water generating operation state using the second embodiment, and FIG. 13 is a flowchart of a hot-water generating operation.

Referring to FIGS. 12 and 13, the controller may perform control to operate the first pump 411 and stop the second pump 423 to form a second flow path in the hot-water generating operation.

Specifically, when the hot-water generating operation is requested, the first pump 411 may be operated by the controller, and the second pump 423 may be stopped by the controller. At this time, heating-water passing through the hot-water heat exchanger 300 may flow downstream through the second connecting pipe 440, the third connecting pipe 450, and the heating-water circulation pipe 410 and may be supplied to the main heat exchanger 200. The heating-water heated in the main heat exchanger 200 may be supplied to the hot-water heat exchanger 300, and a circulation flow path along which the heating-water circulates may be formed between the hot-water heat exchanger 300 and the main heat exchanger 200. FIG. 14 is a view illustrating a simultaneous operation state of heating and hot-water generation using the second embodiment, and FIG. 15 is a flowchart of a simultaneous operation of heating and hot-water generation.

As described above, in the simultaneous operation of heating and hot-water generation, the controller may form at least one of the first flow path or the second flow path depending on the temperature of heating-water released to the second connecting pipe 440. Furthermore, the controller may control the heating value of the burner, which transfers heat of combustion to the main heat exchanger 200, such that the temperature of the heating-water released to the second connecting pipe 440 reaches the preset heating temperature.

Referring to FIGS. 14 and 15, in the second embodiment, in the simultaneous operation of heating and hot-water generation, the controller may perform control to operate the first pump 411 and the second pump 423 to form the first flow path and may thereafter control operation of the first pump 411 and the second pump 423 to form the second flow path in consideration of the temperature of the heating-water released to the heating-water supply pipe 420.

Specifically, when the simultaneous operation is requested, the first flow path may be formed while the first pump 411 and the second pump 423 are operated by the controller. When the first pump 411 is operated, the heating-water supplied to the object H being heated flows to the main heat exchanger 200 through the heating-water circulation pipe 410, the heating-water flows to the hot-water heat exchanger 300 through the first connecting pipe 430, and the heating-water flows, through the second connecting pipe 440 and the heating-water supply pipe 420, to the object H being heated.

At this time, the temperature of the second connecting pipe 440 may be controlled in consideration of the heating-water. Thereafter, when the temperature of the second connecting pipe 440 deviates from the preset heating temperature depending on a service load of heating and hot-water, the amount of the heating-water flowing along the first flow path may be adjusted, or the second flow path may be formed, in consideration of the temperature of the heating-water in the second connecting pipe 440. Accordingly, the hot-water generating operation and the heating operation may be stably performed at the same time.

Specifically, referring to FIG. 15, in the simultaneous operation of heating and hot-water generation, the controller may decrease the flow rate of the heating-water passing through the hot-water heat exchanger 300 by reducing the speed of the first pump 411 in a case where the temperature of the heating-water in the heating-water supply pipe 420 is lower than the preset heating temperature even though the heating value of the burner is controlled to the maximum.

However, in a case where the temperature of the heating-water in the heating-water supply pipe 420 (the temperature of the third supply temperature sensor 425) is lower than the preset heating temperature even though the speed of the first pump 411 is reduced to the minimum, the controller may perform control to operate the first pump 411 and stop the second pump 4 to form the second flow path. At this time, the boiler stops the heating operation and performs only the hot-water generating operation. Thereafter, when the temperature of the third supply temperature sensor 425 reaches the preset heating temperature, the controller may perform the simultaneous operation of heating and hot-water generation again.

In contrast, referring to FIG. 8, in the simultaneous operation of heating and hot-water generation, the controller may perform control to operate the first pump 411 and stop the second pump 421 to form the second flow path in a case where the temperature of the heating-water supply pipe 420 is higher than the preset heating temperature.

Meanwhile, modified examples of the second embodiment of the present disclosure are illustrated in FIGS. 16 and 17. The modified examples of the second embodiment are characterized in that some parts are provided outside a boiler body 110. Specifically, in the combined heating and hot-water boiler 100 according to the present disclosure, all components may be installed to be received in the boiler body 110 as in the embodiment illustrated in FIG. 9, and some components may be installed outside the boiler body 110 as in the modified examples illustrated in FIGS. 16 and 17.

For example, referring to FIG. 16, the second pump 421 may be connected to the external heating-water supply pipe 4202.

In another example, as in the modified example illustrated in FIG. 17, a third connecting pipe 4500 may connect the second external connecting pipe 4402 and the external heating-water circulation pipe 4102 and may be provided outside the boiler body 110. In this case, a member connecting the third connecting pipe 4500 and the second external connecting pipe 4402 and a member connecting the third connecting pipe 4500 and the external heating-water circulation pipe 4102 may also be installed outside the boiler body 110.

Furthermore, the heating-water supply pipe 4202 may be connected to the second external connecting pipe 4402. In this case, the entire heating-water supply pipe 4202 may be provided outside, and the second pump 423 and the third supply temperature sensor 425 provided on the heating-water supply pipe 4202 may also be installed outside the boiler body 110. The first pump 411 may also be installed on the external heating-water circulation pipe 4102.

As illustrated in FIGS. 16 and 17, operation of the first pump 411 or the second pump 423 may be facilitated as the third connecting pipe 4500 and the first pump 411 or the second pump 423 are installed outside the boiler body 110. Furthermore, installation of a part may be facilitated because some parts, such as the first pump 411, the second pump 423, and the like, and connecting portions thereof are installed outside the boiler body 110. In addition, as the internal configuration of the boiler body 110 is simplified and the space requirement is reduced, there is an advantage in that the size of the boiler is reduced.

Meanwhile, a method for controlling the combined heating and hot-water boiler according to the second embodiment of the present disclosure will be described below with reference to FIG. 15. The control method of the combined heating and hot-water boiler according to another aspect of the present disclosure, which will be described below, is a control method using the above-described combined heating and hot-water boiler according to the second embodiment of the present disclosure. Accordingly, repetitive descriptions identical to ones given above will be omitted.

The control method of the combined heating and hot-water boiler 100 according to the second embodiment of the present disclosure includes a flow path formation step, a heating temperature adjustment step, and a hot-water temperature adjustment step.

In the flow path formation step, when a simultaneous operation of heating and hot-water generation is requested, at least one of the first flow path for supplying heating-water passing through the hot-water heat exchanger 300 to the object H to be heated or the second flow path for supplying the heating-water passing through the hot-water heat exchanger 300 to the main heat exchanger 200 is formed in consideration of the temperature of the heating-water passing through the hot-water heat exchanger 300.

In the heating temperature adjustment step, the heating value of the burner is controlled such that the heating-water passing through the hot-water heat exchanger 300 reaches the preset heating temperature.

In the hot-water temperature adjustment step, the temperature of hot-water generated by being heat-exchanged in the hot-water heat exchanger 300 is adjusted to reach the preset hot-water temperature.

According to the present disclosure, all of the heating-water heated in the main heat exchanger 200 is supplied to the hot-water heat exchanger 300, and thereafter the heating-water is supplied to a heating device or circulated to the main heat exchanger 200. Accordingly, the hot-water generating operation and the heating operation may be stably performed at the same time.

Third Embodiment

Hereinafter, a combined heating and hot-water boiler 100 according to a third embodiment of the present disclosure will be described with reference to FIG. 18. The combined heating and hot-water boiler 100 according to the third embodiment differs from the combined heating and hot-water boiler 100 according to the first embodiment in that a flow of heating-water is controlled by a three-way valve 460 instead of the hot-water valve 451 and the heating valve 421 of the first embodiment, and the remaining configuration is the same as that in the first embodiment. No detailed description of the same configuration will be provided, and the following description will be focused on the difference.

Figure 18:
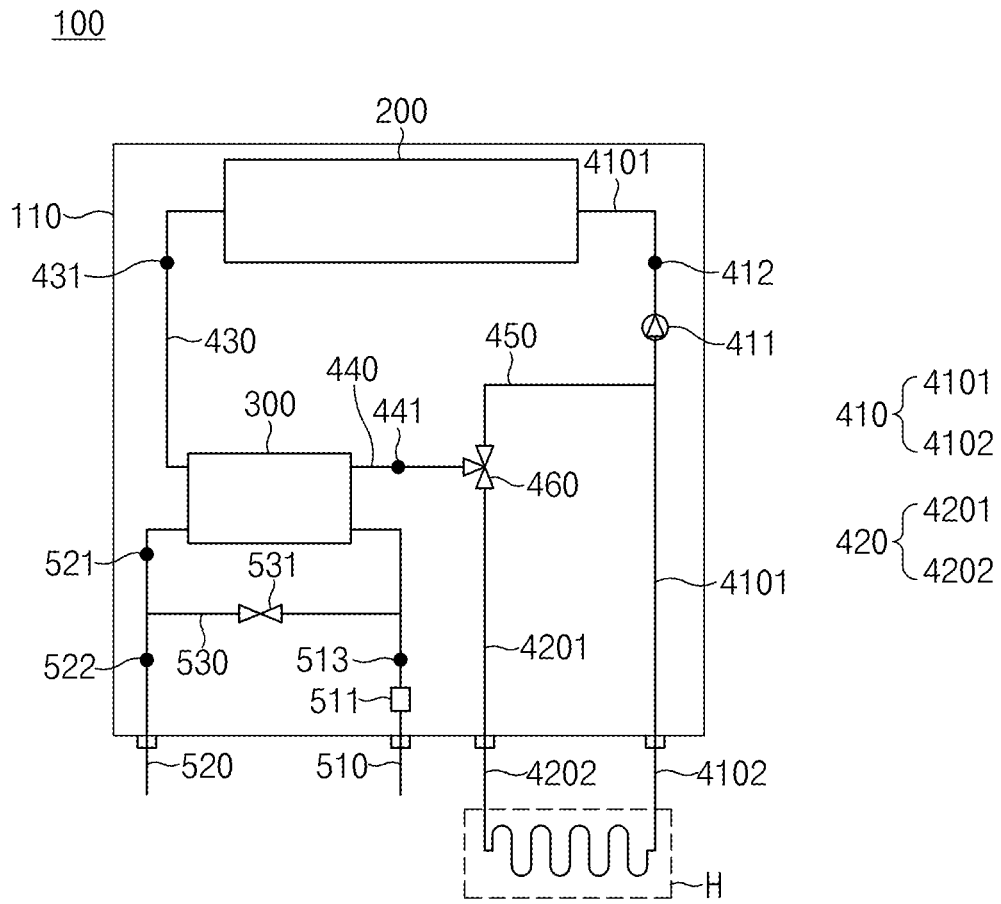
FIG. 18 is a view illustrating a configuration of a combined heating and hot-water boiler according to a third embodiment of the present disclosure.

Referring to FIG. 18, the third embodiment of the present disclosure may further include the three-way valve 460. The three-way valve 460 may be installed at a connection point between the second connecting pipe 440, the heating-water supply pipe 420, and the third connecting pipe 450. In the third embodiment of the present disclosure, the second connecting pipe 440 may be selectively connected to one of the heating-water supply pipe 420 and the third connecting pipe 450 by the three-way valve 460. Accordingly, heating-water passing through the hot-water heat exchanger 300 may be supplied to one of the heating-water supply pipe 420 and the third connecting pipe 450. The controller may control the three-way valve 460 depending on a heating operation, a hot-water generating operation, or a simultaneous operation of heating and hot-water generation.

Here, the three-way valve 460 may be an opening/shutting valve of an on/off type and may be a proportional control valve capable of position control.

In the combined heating and hot-water boilers and the control methods thereof according to the present disclosure, the flow paths are formed such that all of the heating-water heated in the main heat exchanger is supplied to the hot-water heat exchanger and thereafter the heating-water is supplied to a heating device or circulated to the main heat exchanger. Accordingly, the hot-water generating operation and the heating operation may be stably performed at the same time.

In addition, according to the present disclosure, the mixing valve may solve the problem that the temperature of hot-water is raised due to simultaneous performance of a heating operation and a hot-water generating operation and may enable the supply of hot-water at an appropriate temperature.

Hereinabove, although the present disclosure has been described with reference to exemplary embodiments and the accompanying drawings, the present disclosure is not limited thereto, but may be variously modified and altered by those skilled in the art to which the present disclosure pertains without departing from the spirit and scope of the present disclosure claimed in the following claims.

The invention claimed is:

1. A boiler for heating and hot-water comprising:

a main heat exchanger configured to heat heating-water by heat exchange;

a hot-water heat exchanger supplied with the heating-water heated in the main heat exchanger and configured to heat raw water into hot-water by heat exchange with the heating-water;

a controller configured to control a flow of the heating-water passing through the hot-water heat exchanger to form at least one of a first flow path along which the heating-water passing through the hot-water heat exchanger is supplied to an object to be heated and a second flow path along which the heating-water passing through the hot-water heat exchanger is supplied to the main heat exchanger;

a heating-water circulation pipe configured to circulate the heating-water to the main heat exchanger;

a second connecting pipe to which the heating-water heat-exchanged in the hot-water heat exchanger is released; and a third connecting pipe configured to connect the second connecting pipe and the heating-water circulation pipe, wherein the controller is configured to form the second flow path by allowing the heating-water passing through the hot-water heat exchanger to flow to the second connecting pipe, the third connecting pipe, and downstream of the heating-water circulation pipe.

2. The boiler of claim 1, further comprising:

a first connecting pipe configured to connect the main heat exchanger and the hot-water heat exchanger such that all of the heating-water heat-exchanged in the main heat exchanger is supplied to the hot-water heat exchanger.

3. The boiler of claim 1, further comprising:

a heating-water supply pipe connected to the object to be heated for supply of the heating-water and connected to the second connecting pipe, and wherein the controller is configured to form the first flow path by allowing the heating-water passing through the hot-water heat exchanger to flow to the second connecting pipe and the heating-water supply pipe.

4. The boiler of claim 3, wherein the controller is configured to form at least one of the first flow path and the second flow path depending on temperature of the heating-water released to the second connecting pipe in a simultaneous operation of heating and hot-water generation.

5. The boiler of claim 3, wherein the controller is configured to control a heating value of a burner configured to transfer heat of combustion to the main heat exchanger, such that temperature of the heating-water released to the second connecting pipe reaches a preset heating temperature in a simultaneous operation of heating and hot-water generation.

6. The boiler of claim 3, further comprising:

a raw water pipe through which raw water to be heat-exchanged in the hot-water heat exchanger is supplied;

a hot-water pipe through which first hot-water generated by heat exchange in the hot-water heat exchanger is released;

a mixing pipe connected between the raw water pipe and the hot-water pipe; and a mixing valve installed on the mixing pipe and configured to adjust an amount of the raw water to be mixed, wherein the controller is configured to adjust the mixing valve such that temperature of second hot-water released to an outside through the hot-water pipe reaches a preset hot-water temperature.

7. The boiler of claim 6, further comprising:

a first hot-water temperature sensor provided on the hot-water pipe upstream of a connection point between the hot-water pipe and the mixing pipe to sense temperature of the first hot-water; and a second hot-water temperature sensor provided on the hot-water pipe downstream of the connection point between the hot-water pipe and the mixing pipe to sense the temperature of the second hot-water, wherein the controller is configured to adjust the mixing valve based on the temperature sensed by the first hot-water temperature sensor such that the temperature sensed by the second hot-water temperature sensor reaches the preset hot-water temperature.

8. The boiler of claim 3, further comprising:

a heating valve installed on the heating-water supply pipe and configured to open and close the heating-water supply pipe; and a hot-water valve installed on the third connecting pipe and configured to open and close the third connecting pipe.

9. The boiler of claim 8, wherein the controller is configured to perform control to close the hot-water valve and open the heating valve to form the first flow path in a heating operation and perform control to close the heating valve and open the hot-water valve to form the second flow path in a hot-water generating operation.

10. The boiler of claim 8, wherein the controller is configured to perform control to close the hot-water valve and open the heating valve to form the first flow path and thereafter control the hot-water valve and the heating valve to form the second flow path based on temperature of the heating-water released to the second connecting pipe, when a simultaneous operation of heating and hot-water generation is requested.

11. The boiler of claim 10, wherein the controller is configured to decrease a flow rate of the heating-water passing through the hot-water heat exchanger by reducing an opening degree of the heating valve, when the temperature of the heating-water in the second connecting pipe is lower than a preset heating temperature even though a heating value of a burner configured to transfer heat of combustion to the main heat exchanger is controlled to the maximum.

12. The boiler of claim 11, wherein the controller is configured to perform control to open the hot-water valve and close the heating valve to form the second flow path, when the temperature of the heating-water in the second connecting pipe is lower than the preset heating temperature even though the opening degree of the heating valve is adjusted to the minimum.

13. The boiler of claim 10, wherein the controller is configured to perform control to open the hot-water valve and close the heating valve to form the second flow path, when the temperature of the heating-water in the second connecting pipe is higher than a preset heating temperature.

14. The boiler of claim 3, further comprising:

a first pump installed on the heating-water circulation pipe and configured to circulate the heating-water to the main heat exchanger; and a second pump installed on the heating-water supply pipe and configured to supply the heating-water in the second connecting pipe to the object to be heated.

15. The boiler of claim 14, wherein the controller is configured to perform control to operate the first pump and the second pump to form the first flow path in a heating operation and perform control to operate the first pump and stop the second pump to form the second flow path in a hot-water generating operation.

16. The boiler of claim 14, wherein the controller is configured to perform control to operate the first pump and the second pump to form the first flow path and thereafter control operation of the first pump and the second pump to form the second flow path based on temperature of the heating-water released to the heating-water supply pipe, when a simultaneous operation of heating and hot-water generation is requested.

17. The boiler of claim 16, wherein the controller is configured to decrease a flow rate of the heating-water passing through the hot-water heat exchanger by reducing speed of the first pump, when the temperature of the heating-water in the heating-water supply pipe is lower than a preset heating temperature even though a heating value of a burner configured to transfer heat of combustion to the main heat exchanger is controlled to the maximum.

18. The boiler of claim 17, wherein the controller is configured to perform control to operate the first pump and stop the second pump to form the second flow path, when the temperature of the heating-water in the heating-water supply pipe is lower than the preset heating temperature even though the speed of the first pump is adjusted.

19. The boiler of claim 16, wherein the controller is configured to perform control to operate the first pump and stop the second pump to form the second flow path, when the temperature of the heating-water in the heating-water supply pipe is higher than a preset heating temperature.

20. The boiler of claim 14, further comprising:

a boiler body in which the main heat exchanger and the hot-water heat exchanger are received, wherein the heating-water supply pipe includes an internal heating-water supply pipe provided inside the boiler body and connected with the second connecting pipe and an external heating-water supply pipe provided outside the boiler body and connected to the object to be heated, the external heating-water supply pipe extending from the internal heating-water supply pipe, and wherein the second pump is connected to the external heating-water supply pipe.

21. The boiler of claim 14, further comprising:

a boiler body in which the main heat exchanger and the hot-water heat exchanger are received, wherein the heating-water circulation pipe includes an internal heating-water circulation pipe provided inside the boiler body and connected to the main heat exchanger and an external heating-water circulation pipe provided outside the boiler body and connected to the object to be heated, the external heating-water circulation pipe extending from the internal heating-water circulation pipe, wherein the second connecting pipe includes a second internal connecting pipe provided inside the boiler body and connected to the hot-water heat exchanger and a second external connecting pipe provided outside the boiler body and extending from the second internal connecting pipe, wherein the third connecting pipe connects the second external connecting pipe and the external heating-water circulation pipe and is provided outside the boiler body, wherein the heating-water supply pipe is connected to the second external connecting pipe, and wherein the first pump is connected to the external heating-water circulation pipe.

22. A method for controlling a boiler for heating and hot-water, the method comprising:

a flow path formation step of forming at least one of a first flow path along which heating-water passing through a hot-water heat exchanger is supplied to an object to be heated and a second flow path along which the heating-water passing through the hot-water heat exchanger is supplied to a main heat exchanger, based on temperature of the heating-water passing through the hot-water heat exchanger when a simultaneous operation of heating and hot-water generation is requested;

a heating temperature adjustment step of controlling a heating value of a burner such that the heating-water passing through the hot-water heat exchanger reaches a preset heating temperature; and a hot-water temperature adjustment step of making an adjustment such that temperature of hot-water generated by being heat-exchanged in the hot-water heat exchanger reaches a preset hot-water temperature;

the boiler for heating and hot-water comprising:

a heating-water circulation pipe configured to circulate the heating-water to the main heat exchanger;

a second connecting pipe to which the heating-water heat-exchanged in the hot-water heat exchanger is released; and a third connecting pipe configured to connect the second connecting pipe and the heating-water circulation pipe, wherein in the flow path formation step, the second flow path is formed by allowing the heating-water passing through the hot-water heat exchanger to flow to the second connecting pipe, the third connecting pipe, and downstream of the heating-water circulation pipe.

* * * * *